US012006847B2

(12) United States Patent
Lebenbom

(10) Patent No.: US 12,006,847 B2
(45) Date of Patent: Jun. 11, 2024

(54) EXOTHERMIC REACTION ENERGY SYSTEM

(71) Applicant: ADVANTRON TECHNOLOGIES, LLC, West Bloomfield, MI (US)

(72) Inventor: Matthew Lebenbom, West Bloomfield, MI (US)

(73) Assignee: ADVANTRON TECHNOLOGIES, LLC, West Bloomfield, MI (US)

( * ) Notice: Subject to any disclaimer, the term of this patent is extended or adjusted under 35 U.S.C. 154(b) by 401 days.

(21) Appl. No.: 17/279,312

(22) PCT Filed: Sep. 24, 2019

(86) PCT No.: PCT/US2019/052611
§ 371 (c)(1),
(2) Date: Mar. 25, 2021

(87) PCT Pub. No.: WO2020/072238
PCT Pub. Date: Apr. 9, 2020

(65) Prior Publication Data

US 2021/0396158 A1 Dec. 23, 2021

Related U.S. Application Data

(60) Provisional application No. 62/735,310, filed on Sep. 24, 2018.

(51) Int. Cl.
*F01K 15/02* (2006.01)
*F01K 1/04* (2006.01)
(Continued)

(52) U.S. Cl.
CPC ..... *F01K 15/02* (2013.01); *F01K 1/04* (2013.01); *F01K 1/08* (2013.01); *F01K 3/10* (2013.01); *F01K 3/16* (2013.01); *F01K 3/188* (2013.01)

(58) Field of Classification Search
CPC ... F01K 15/02; F01K 1/04; F01K 1/08; F01K 3/10; F01K 3/16; F01K 3/188; F01K 17/04; F22B 3/00
See application file for complete search history.

(56) References Cited

U.S. PATENT DOCUMENTS 4,342,876 A 8/1982 Klingman
4,794,682 A 1/1989 Burford
(Continued)

FOREIGN PATENT DOCUMENTS

WO 2012/069850 A1 5/2012

OTHER PUBLICATIONS

European Search Report and Supplementary Search Report, Application No. EP 19868856.6 dated Jun. 3, 2022.
(Continued)

*Primary Examiner* — Hoang M Nguyen
(74) *Attorney, Agent, or Firm* — The Dobrusin Law Firm, P.C.; Daniela M. Thompson-Walters

(57) ABSTRACT

An energy system having a) one or more catalyst sources which store a catalyst; b) one or more water sources which store water; c) one or more heat sources which store a heat storage medium; d) one or more reaction chambers into which the water, the catalyst, and the heat storage medium are introduced, which are configured for an exothermic reaction between the catalyst and the water to take place while in the presence of the heat storage medium, and in which steam is generated from the exothermic reaction; and f) one or more turbines downstream of the one or more reaction chambers which are adapted to be driven by the steam generated within the one or more reaction chambers.

20 Claims, 14 Drawing Sheets

(51) Int. Cl.

| | |
|---|---|
| ***F01K 1/08*** | (2006.01) |
| ***F01K 3/10*** | (2006.01) |
| ***F01K 3/16*** | (2006.01) |
| ***F01K 3/18*** | (2006.01) |

(56) References Cited

U.S. PATENT DOCUMENTS

| | | | | |
|---|---|---|---|---|
| 8,723,382 | B2 | 5/2014 | Lebenbom | |
| 8,864,857 | B1 * | 10/2014 | Mayne | C01B 3/065 423/655 |
| 9,011,572 | B1 | 4/2015 | Bunker et al. | |
| 2009/0252671 | A1 | 10/2009 | Fullerton | |
| 2010/0282236 | A1 | 11/2010 | Xiao et al. | |
| 2011/0117459 | A1 * | 5/2011 | McGill | B01J 7/02 204/243.1 |
| 2011/0252800 | A1 * | 10/2011 | Cawley | F01K 21/04 60/645 |
| 2011/0256052 | A1 | 10/2011 | Merritt | |
| 2013/0014710 | A1 | 1/2013 | Munson et al. | |
| 2015/0233266 | A1 * | 8/2015 | Firkan | F01K 15/04 60/645 |
| 2015/0266730 | A1 * | 9/2015 | Bunker | C01B 3/042 423/657 |
| 2017/0284227 | A1 * | 10/2017 | Eckert | F24V 30/00 |
| 2017/0291824 | A1 * | 10/2017 | Eckert | C01C 1/02 |
| 2018/0328584 | A1 * | 11/2018 | Eckert | F23C 99/00 |
| 2021/0050609 | A1 * | 2/2021 | Detsi | C25B 11/046 |

OTHER PUBLICATIONS

International Search Report & Written Opinion, Application No. PCT/US2019/052611 dated Mar. 5, 2020.

International Preliminary Report on Patentability, Application No. PCT/US2019/052611 dated Mar. 5, 2020.

* cited by examiner

EXOTHERMIC REACTION ENERGY SYSTEM

CROSS REFERENCE TO RELATED APPLICATIONS

Applicant claims the benefit of U.S. Provisional Application No.: 62/735,310 filed on Sep. 24, 2018, the contents of which are incorporated herein by reference in their entirety.

FIELD

The disclosure relates to an energy system. The energy system may be useful in converting released heat from a chemical reaction into mechanical energy. The energy system may be compatible with a power system to convert mechanical energy into electrical energy. The energy system may be particularly useful in vehicles for integration with the drivetrain and vehicle components, buildings for providing electricity, and even integrating into power grids, while providing an environmentally clean solution for generating energy.

BACKGROUND

There are ongoing efforts in finding alternative energy systems for providing sufficient electricity to power vehicles, facilities, and even electrical grid networks. Vehicles still heavily rely on petroleum to generate energy for the drivetrain. The use of petroleum may lead to a variety of environmental problems both before and after consumption by the vehicle's engine. In the process of transporting and storing oil there are the possibilities of oil spills, pipeline explosions, and even fires which are harmful to the environment. When cars burn gasoline, even with the use of filtering systems, emissions including carbon monoxide, carbon dioxide, nitrogen oxide, and unburned hydrocarbons may be generated which may result in harmful air pollution. Power plants for generating and distributing electricity also have problems which negatively impact the environment. Burning of coal in coal power plants may release mercury, lead, sulfur dioxide, nitrogen oxides, particulates, and other heavy metals and may result in smog, toxic ash, and acid rain. A concern in nuclear power plants is the creation of radioactive waste, including uranium mill tailings, spent reactor fuel, and other radioactive wastes.

While green energy systems and plants have been created, they still present challenges of their own. For example, challenges in designing an electric vehicle is the packaging of the various components within the chassis, and balancing packaging size and energy density of the electric system versus a desired distance range. Even green energy plants can pose problems to the environment. As one example, windmill turbines may be dangerous and potentially deadly obstacles for birds, a blade may break-away as a large projectile, susceptibility to ice formation in colder climates which may result in projectiles (e.g., ice), and even the sub-sonic noise may negatively impact human health. As another example, solar panel arrays may require a large amount of real estate, and the production of the solar panels may generate greenhouse gases such as nitrogen trifluoride.

It would be advantageous to have an energy system capable of being scaled, such as sufficient to power a vehicle, replacing a residential or commercial system, to even replacing a power plant and distributing the energy. What is needed is an energy system which is not reliant on fossil fuels. What is needed is a system which can replace a combustible reaction and thus eliminate a number of potentially dangerous emissions resulting from the combustible reaction. Additionally, what is needed is an energy system which can utilize already existing infrastructures of a vehicle, facility, or even power plant to distribute the energy generated.

SUMMARY

The disclosure relates to an energy system comprising: a) one or more catalyst sources which store a catalyst; b) one or more water sources which store water; c) one or more heat sources which store a heat storage medium; d) one or more reaction chambers into which the water, the catalyst, and the heat storage medium are introduced, which are configured for an exothermic reaction between the catalyst and the water to take place while in the presence of the heat storage medium, and in which steam is generated from the exothermic reaction; and e) one or more turbines downstream of the one or more reaction chambers which are adapted to be driven by the steam generated within the one or more reaction chambers.

The disclosure relates to a vehicle having: a) an energy system; b) a power system; and c) a drivetrain in communication with a generator of the power system.

The disclosure relates to a vehicle having: a) an energy system comprising: i) one or more catalyst sources which store a catalyst; ii) one or more water sources which store water; iii) one or more heat sources which store a heat storage medium; iv) one or more reaction chambers into which the water, the catalyst, and the heat storage medium are introduced, which are configured for an exothermic reaction between the catalyst and the water to take place while in the presence of the heat storage medium, and in which steam is generated from the exothermic reaction; and v) one or more turbines downstream of the one or more reaction chambers which are adapted to be driven by the steam generated within the one or more reaction chambers; b) a power system comprising: i) a generator in communication with the one or more turbines; ii) a motor in communication with the generator; and c) a drivetrain in communication with the motor.

The present disclosure also relates to a method for creating energy via an energy system comprising the steps of: a) dispensing a catalyst into one or more reaction chambers for creating an exothermic reaction with water to generate heat; b) introducing a portion of the heat into a heat storage medium adapted to store thermal energy; c) generating steam from the combination of a presence of heat stored within the heat storage medium, the water, and the catalyst; and) dispensing the steam at a pre-determined pressure to convert the steam into mechanical energy.

The energy system of the present disclosure may be beneficial as it may be scaled to varying needs by the sizing and quantity of reaction chambers, catalyst sources, heat sources, water sources, to create a desired steam pressure level. The energy system may be compatible with any receiving system capable of receiving mechanical or kinetic energy as an input, such as a generator. A generator in communication with the turbine of the system may be beneficial in converting the kinetic or mechanical energy into electrical energy which can then be adapted for a number of applications. The energy system may rely on an exothermic reaction instead of a combustible reaction, thus advantageous in eliminating a number of emissions in the reaction. The energy system may be easily integrated with a drivetrain of a vehicle and compatible with typical vehicle components.

DETAILED DESCRIPTION

Figure 1:
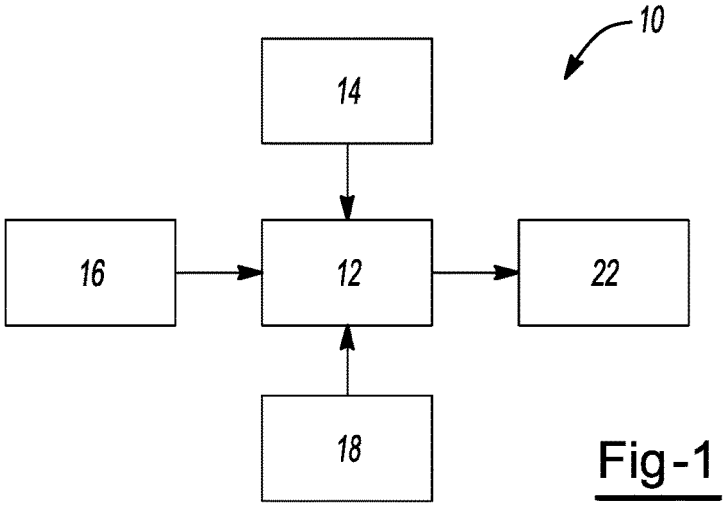
FIG. 1 illustrates a schematic of an energy system suitable for creating energy.

The explanations and illustrations presented herein are intended to acquaint others skilled in the art with the present teachings, its principles, and its practical application. The specific embodiments of the present teachings as set forth are not intended as being exhaustive or limiting of the present teachings. The scope of the present teachings should be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

Energy System

The present teachings relate to an energy system. The energy system may function to generate, store, and release energy. The energy system may function to generate an exothermic reaction, collect resulting heat from the reaction, or both. The energy system may function to pressurize a steam resulting from an exothermic reaction, release the steam, or both. The energy system may be any system suitable for converting thermal energy into mechanical energy, such as kinetic energy. The energy system may be compatible with any system which may be compatible with a mechanical energy input. The energy system may include one or more reaction chambers, heat sources, catalyst sources, water sources, turbines, or any combination thereof.

The energy system may include one or more reaction chambers. The one or more reaction chambers may function to house one or more exothermic reactions; allow sufficient heat, pressure, or both to build-up (e.g., collect) to activate or continue to turn a turbine; or any combination thereof. The one or more reaction chambers may be any suitable shape, size, and/or configuration for housing one or more exothermic reactions, allowing steam pressure to build-up, or both. The one or more reaction chambers may be fully or partially hollow. A hollow interior may allow for one or more liquids, catalysts, heat storage mediums, pressure maintenance features, or any combination thereof to reside within a reaction chamber. The one or more reaction chambers may have a shape which is substantially cylindrical, cubical, cuboidal, conical, pyramidical, spherical, hemispherical, prismed, the like, or any combination thereof. For example, the one or more reaction chambers may have a shape which is cylindrical with hemispherical opposing ends (e.g., rounded, concave ends). The one or more reaction chambers may have any suitable size to allow sufficient size for housing both a liquid and steam generated from an exothermic reaction, allow pressure to build-up in the steam from an exothermic reaction, allow retained heat from the reaction to heat liquid into a steam, or any combination thereof. The one or more reaction chambers may have a size suitable for residing within an engine compartment, chassis space, or both of a vehicle; within an area of a facility; within a power plant; the like; or any combination thereof. The one or more reaction chambers may have a volume which is about 0.001 cubic meters or greater, about 0.005 cubic meters or greater, about 0.01 cubic meters or greater, about 0.03 cubic meters or greater, or even about 0.05 cubic meters or greater. The one or more reaction chambers may have a volume which is about 20 cubic meters or less, about 15 cubic meters or less, about 10 cubic meters or less, about 5 cubic meters or less, or even about 1 cubic meter or less. The one or more reaction chambers may be made of one or more materials suitable for housing pressure, heat, steam, or any combination thereof generated from the exothermic reaction. The one or more materials may be suitable for retaining temperatures from about 100° C. or greater, about 150° C. or greater, or even about 200° C. or greater. The one or more materials be suitable for temperatures of about 100° C. or less, about 500° C. or less, about 400° C. or less, or even about 300° C. or less. The one or more materials of a reaction chamber may include one or more metals, ceramics, polymers, the like, or any combination thereof. One or more metals may include steel, chrome, copper, cobalt, aluminum, iron, nickel, silver, titanium, lead, tungsten, the like, or any combination thereof. Lighter metals may be desired when overall weight of the energy system is important, such as when used in a vehicle. One or more reaction chambers may include a single or a plurality of reaction chambers. One or more reaction chambers may include 1 or more, 2 or more, 4 or more, 6 or more, or even 10 or more reaction chambers. One or more reaction chambers may include 300 or less, 250 or less, or even 100 or less reaction chambers. The number of reaction chambers may be selected to receive the necessary amount of catalysts, heat storage mediums, water, or a combination thereof to create a sufficient exothermic reaction and steam to power one or more vehicles, facilities, electrical grids, or a combination thereof. The one or more reaction chambers may be in direct communication with one or more catalyst sources, heat sources, water sources, turbines, or any combination thereof. The one or more reaction chambers may have one or more inlets, outlets, or both. The one or more reaction chambers may have one or more inlets suitable for receiving one or more catalysts from one or more catalyst sources, water from one or more water sources, heat storage mediums from one or more heat sources, or any combination thereof. One or more inlets may include 1 or more, 2 or more, 3 or more, 4 or more, or even 5 more inlets. One or more inlets may include 10 or less, 8 or less, or even 7 or less inlets. The one or more reaction chambers may have one or more outlets suitable for transmitting one or more products from one or more reactions to one or more turbines. The one or more outlets, inlets, or both may include or be free of one or more valves. For example, one or more valves may be located at one or more inlets in communication with one or more catalyst sources, water sources, or both. The one or more reaction chambers may be located in proximity to, distanced from, or a combination thereof to one or more catalyst sources, water sources, heat sources, turbines, or a combination thereof.

The energy system may include one or more catalyst sources. The one or more catalyst sources may function to receive, store, dispense or any combination thereof one or more catalysts; dispense one or more catalysts into a reaction chamber, or any combination thereof. The one or more catalyst sources may have any size, shape, and/or configuration to allow storage and dispensing of one or more catalysts to one or more reaction chambers. The one or more catalyst sources may have a size suitable for residing within an engine compartment, chassis space, or both of a vehicle; within an area of a facility; within a power plant; the like; or any combination thereof. The one or more catalyst sources may be substantially cylindrical, cubical, cuboidal, conical, pyramidical, spherical, hemispherical, prismed, the like, or any combination thereof. A catalyst source may have a substantially pyramidical shape such that the catalyst source tapers in the direction of an outlet, opening, reaction chamber, inlet of a reaction chamber, or a combination thereof. A catalyst source may include one or more bodies, openings, lids, caps, fasteners, or a combination thereof. A catalyst source may have a body. The body may function to retain one or more catalysts. The body may include one or more openings. The one or more openings may allow for dispensing, receiving, or both of one or more catalysts. One or more openings may receive one or more inlets, valves, or both therethrough. One or more openings may be located at the narrowest portion of the catalyst source. One or more openings may be located opposite a lid of the catalyst source. One or more openings may also be included in a lid of a catalyst source. The one or more openings may be suitable for receiving a cap. For example, the one or more openings may include a threaded surface along an inner surface, a neck with a threaded surface along an outer surface, or both for engaging a cap with threads. The body may be covered by one or more lids. The one or more lids may be affixed to the body by one or more fasteners. For example, one of more hex screws may secure the lid to the body of the catalyst source. The body, lid, or both may include one or more seals about a periphery. For example, the lid, body, or both may include a gasket. The one or more catalyst sources may be made of any material suitable for storing one or more catalysts therein, being non-reactive with one or more catalysts, or both. For example, the one or more catalyst sources may be comprised of one or more metals suitable for having aluminum nanoparticles stored therein. The one or more catalyst sources may be upstream of one or more reaction chambers. The one or more catalyst sources may be in direct or indirect communication with one or more reaction chambers. One or more reaction chambers may be in communication with the one or more catalyst sources via one or more delivery lines, a valve, via an opening, or a combination thereof. As an example, a valve of a reaction chamber may reside within an opening of a catalyst source to avoid the use of an additional delivery line. One or more catalyst sources may include a single or a plurality of catalyst sources. One or more catalyst sources may correspond (e.g., be equal) in number to one or more reaction chambers. There may be the same number or differing number of catalyst sources as reaction chambers of the energy system.

The energy system may include one or more catalysts. The one or more catalysts may function to cooperate with one or more liquids to generate an exothermic reaction, generate heat, or both. The one or more catalysts may be any catalyst suitable for creating an exothermic reaction. The one or more catalysts may be any catalyst suitable for generating thermal energy as a product from reacting with a liquid, such as water. The one or more catalysts may include one or more metals. The one or more metals may include aluminum, lithium, sodium, potassium, rubidium, calcium, barium, strontium, radium, the like, or any combination thereof. The one or more catalysts may be in particle form. The one or more catalysts may be nanoparticles. For example, the one or more catalysts may include one or more aluminum nanoparticles. The one or more catalysts may be organic, inorganic, or both. The one or more catalysts may include a protective barrier. The protective barrier may prevent the one or more catalysts from reacting with their ambient environment, within a catalyst source, or both. The protective barrier may prevent one or more catalysts from coalescing, agglomerating, oxidizing, the like, or a combination thereof. One or more protective barriers may include one or more capping agents applied thereon. For example, the one or more catalysts may be one or more metallic nanoparticles which are capped. The one or more catalysts may be subject to pitting corrosion. The one or more catalysts may be pitted. Pitting corrosion may occur through applying one or more pitting agents onto a surface of the one or more catalysts, locating one or more catalysts into one or more pitting agents, the like, or a combination thereof. One or more pitting agents may include one or more alkalides, the like, or a combination thereof. Pitting corrosion may allow for a more efficient reaction between the catalyst and the liquid. Pitting corrosion may allow for the liquid to better access the catalyst beneath an oxide film, such as an aluminum oxide film. The one or more catalysts may have a certain ratio for mixture with liquid within the reaction chamber. The one or more catalysts may have a ratio relative to 100 mL of the liquid of about 0.01 grams or greater (1 g:100 mL), about 0.1 grams or greater (0.1 g:100 mL), about 0.5 grams or greater (0.5 g:100 mL), or even about 1 gram or greater (1 g:100 mL). The one or more catalysts may have a ratio relative to 100 mL of the liquid of about 100 grams or less (100 g:100 mL), about 50 grams or less (50 g:100 mL), about 25 grams or less (25 g:100 mL), about 10 grams or less (10 g:100 mL), or even about 5 grams or less (5 g:100 mL). An exemplary range of catalyst to liquid may be about 0.5 grams to 5 grams of catalyst to 100 mL of liquid. The one or more catalysts may not react with all of the liquid within the reaction chamber. Some of the liquid within the reaction chamber may be converted into steam instead of reacting with the catalyst.

The energy system may include one or more water sources. The one or more water sources may function to receive, store, dispense, or any combination thereof one or more liquids. The one or more water sources may have any size, shape, and/or configuration for storing one or more liquids therein which are suitable for reacting with one or more catalysts. The one or more water sources may have a shape which is substantially cylindrical, cubical, cuboidal, conical, pyramidical, spherical, hemispherical, prismed, the like, or any combination thereof. The one or more water sources may have a shape substantially similar to a typical fuel-tank of a vehicle (e.g., gasoline storage fuel tank). The one or more water sources may be configured to be located within an engine compartment, chassis, or both of a vehicle; within a facility; within a power plant; or any combination thereof. The one or more water sources may be located at an opposite end of a vehicle as one or more reaction chambers, catalyst sources, heat sources, turbines, or a combination thereof. The one or more water sources may be located at the rear of a vehicle in the vehicle underbody. The one or more water sources may be located where a fuel tank of a gasoline powered vehicle is typically located. The one or more water sources may have any size suitable for providing sufficient liquid for reacting with one or more catalysts, resulting in sufficient steam to activate one or more turbines, or both. The one or more water sources may have an interior storage volume from about 0.1 liters or greater, 10 liters or greater, about 50 liters or greater, about 75 liters or greater, or even about 100 liters or greater. The one or more water sources may have an interior storage volume from about 5,000 liters or less, about 4,000 liters or less, about 3,000 liters or less, about 2,000 liters or less, or even about 1,000 liters or less. The one or more water sources may include a single or a plurality of water sources. For example, a single water source may be integrated into the water system. A single water source may be suitable for use with a single or a plurality of reaction chambers. The one or more water sources may in direct communication, indirect communication, or both with one or more reaction chambers. The one or more water sources may be located upstream of one or more reaction chambers, pumps, water distributors, or any combination thereof. The one or more water sources may be downstream of one or more steam condensers, pumps, or both. The one or more water sources may be affixed to one or more reaction chambers, pumps, water distributors, steam condensers, or any combination thereof via one or more water lines. The one or more water sources may have one or more inlets, outlets, or both. The one or more inlets, outlets, or both may each be connected to one or more water lines.

The energy system may include a plurality of water lines. The water lines may function to place one or more water sources in fluid communication with one or more pumps, reaction chambers, water distributors, condensers, or any combination thereof. The water lines may include one or more incoming water lines, outgoing water lines, or both. One or more outgoing water lines may function to transfer a liquid from the water source to a pump, water distributor, a plurality of other water lines (e.g., multibranch water line), reaction chamber, or any combination thereof. One or more water lines may function to transfer water from one portion of a vehicle, facility, and/or power plant to another portion. One or more water lines may extend from one portion to another portion of a vehicle, facility, and/or power plant. For example, one or more water lines may extend from a front of a vehicle toward a rear of a vehicle. The one or more outgoing water lines may be connected to one or more water sources at one or more outlets. One or more incoming water lines may function to transfer a liquid from a condenser, pump, or both to the water source. One or more incoming water lines may be connected to one or more water sources at one or more inlets. One or more water lines may have one or more water pumps along their length. One or more water pumps may function to aid in movement of a liquid through one or more water lines. One or more water lines may be divided into one or more segments. One or more water lines may be in fluid communication, attached, or both to one or more water distributors. One or more water distributors may function to distribute water from one water line (e.g., one outgoing water line) to a plurality of water lines (e.g., multibranch water line). One or more water distributors may be valve activated. The one or more valves may function simultaneously or separately. The one or more valves of the one or more water distributors may allow a multibranch water line to delivery differing flows of liquid at differing times to a plurality of reaction chambers. A multibranch water line may include a same or greater number of water lines as the number of reaction chambers in the energy system.

The energy system may include one or more liquids. The one or more liquids may function to react with one or more catalysts, react within one or more reaction chambers, create an exothermic reaction, generate heat, convert into a steam, or any combination thereof. The one or more liquids may be any liquid suitable for reacting with one or more catalysts to result in an exothermic reaction, create a steam, or both. One or more liquids may include water, nitrous oxide, the like, or a combination thereof. Water may be particularly advantageous as it can have an exothermic reaction with a catalyst comprising aluminum nanoparticles. Water may include filtered water, distilled water, tap water, oxygenated water with a pH at or above 7, the like, or any combination thereof. The water may be initially dispensed into the energy system into a water source. The water within the energy system may be a volume about equal to or less than an interior volume of a water source. The water may transfer to one or more reaction chambers via one or more water lines. The water may be converted into steam via heat from heat resulting from an exothermic reaction, stored within one or more heat storage mediums, or both.

The energy system may include one or more heat sources. The one or more heat sources may function to place one or more heat storage mediums within a reaction chamber, remove one or more heat storage mediums from a reaction chamber, or both. The one or more heat sources may have any suitable shape, size, and/or configuration for locating and removing one or more heat storage mediums from a reaction chamber. The one or more heat sources may be configured to be located within an engine compartment, chassis, or both of a vehicle; within a facility; within a power plant; or any combination thereof. The one or more heat sources may include one or more tubes, actuators, motors, heat storage mediums, or any combination thereof. The one or more heat sources may include one or more tubes. The one or more tubes may store one or more heat storage mediums. For example, the one or more tubes may store zeolite. The one or more tubes may have a shape which is substantially cylindrical, cubical, cuboidal, conical, pyramidical, spherical, hemispherical, prismed, the like, or any combination thereof. The one or more tubes may have a width (e.g., diameter), length, or both smaller than a diameter or width of one or more reaction chambers. The one or more tubes may be made of any material suitable for storing zeolite, being exposed to temperatures and pressures within a reaction chamber or both. The one or more tubes may be made of one or more metals, ceramics, polymers, or both. The one or more metals may be any metal suitable for a reaction chamber. The one or more tubes may include one or more openings. The openings may include one or more inlets, outlets, or both. One or more openings may include one or more caps. For example, one or more inlets may include one or more caps. The one or more inlets may be suitable for dispensing of one or more heat storage mediums into the one or more tubes. The one or more tubes may be insertable into and removable from one or more reaction chambers via one or more inlet openings. The one or more tubes may be moved into and removed from one or more reaction chambers via one or more actuators. The one or more actuators may include a single or a plurality of actuators. The number of actuators may match the number of reaction chambers of the energy system. One or more actuators may be in communication with both one or more tubes and one or more motors. The one or more actuators may be hydraulic, pneumatic, electrical, thermal, mechanical, the like or any combination thereof. The one or more actuators may function to convert rotational motion into linear motion. One or more actuators may function to convert rotational motion from a motor into linear motion of the one or more tubes. One or more motors may be affixed to one or more actuators. One or more motors may include a single or a plurality of motors. A number of motors may match a number of actuators, tubes, reaction chambers, or a combination thereof. One or more motors may receive power via one or more electrical energy storage mediums. For example, one or more motors may be in electrical communication with one or more fuel cells of a power system.

The energy system may include one or more heat storage mediums. One or more heat storage mediums may function to capture and retain heat resulting from an exothermic reaction within a reaction chamber, heat liquid within a reaction chamber such that it changes form into steam, or both. One more heat storage mediums may be any suitable size, shape, and/or configuration suitable for retaining heat, water, or both resulting from an exothermic reaction within a reaction chamber. The one or more heat storage mediums may be any material capable of storing, releasing, or both heat from an exothermic reaction of a catalyst with water. The one or more heat storage mediums may have an energy density of about 50 $kWh/m^3$ or greater, about 75 $kWh/m^3$ or greater, or even about 100 $kWh/m^3$ or greater. The one or more heat storage mediums may have an energy density of about 2,000 $kWh/m^3$ or less, about 1,000 $kWh/m^3$ or less, or even about 750 $kWh/m^3$ or less. The one or more heat storage mediums may have an open structure with exposed gaps (e.g., cavities, pores). The gaps may function to store water molecules, heat, or both within. The one or more heat storage mediums may have a porous structure, crystalline structure, the like, or a combination thereof. The one or more heat storage mediums may have a porosity of about 15% or greater, about 25% or greater, or even about 50% or greater. The one or more heat storage mediums have may a porosity of about 90% or less, about 80% or less, or even about 75% or less. The one or more heat storage mediums may have a high melting point, may not burn, or both. A high melting point may allow the one or more heat storage mediums to reside within one or more reaction chambers during an exothermic reaction. The one or more heat storage mediums may have a melting point of about 500° C. or higher, about 750° C. or higher, or even about 1,000° C. or higher. The one or more heat storage mediums may have a melting point of about 5,000° C. or less, about 4,000° C. or less, or even about 3,000° C. or less. The one or more heat storage mediums may be pressure resistant at high pressures without deforming. The one or more heat storage mediums may be pressure resistant to 3,000 kPa or greater, about 5,000 kPa or greater, or even about 6,000 kPa or greater. The one or more heat storage mediums may be pressure resistant to about 10,000 kPa or less, about 8,000 kPa or less, or even about 7,000 kPa or less. The one or more heat storage mediums may resist reaction with an ambient environment, within a heat source, or water (e.g., oxidation). The one or more heat storage mediums may not be dissolvable with one or more liquids. For example, the one or more heat storage mediums may not be dissolve in water or other solvents. The one or more heat storage mediums may comprise aluminum, oxygen, silicon, one or more metals (e.g., sodium, potassium, magnesium), the like, or a combination thereof. The one or more heat storage mediums may be zeolite. The zeolite may be natural, synthetic, or a combination of both. The zeolite may capture water molecules from steam released from an exothermic reaction within one or more cavities (e.g., pores) thus also retaining heat. The heat stored within the zeolite may then allow for more of the liquid to be warmed up into a steam and pressurized within the reaction chamber. Steam pressure within a reaction chamber may then be transferred to a turbine.

The energy system may comprise one or more turbines. The turbine may function to convert a flow of thermal energy into a flow of mechanical energy, produce continuous mechanical energy, or both. The turbine may be any type of turbine suitable for receiving energy released from a reaction chamber. The turbine may be a steam turbine. The turbine may have any configuration suitable for converting thermal energy (e.g., steam) from a reaction chamber into mechanical (e.g., kinetic) energy. The turbine may be configured to be located within an engine compartment, chassis, or both of a vehicle; within a facility; within a power plant; or any combination thereof. The turbine may include a housing, one or more shafts, blades, stages, the like, or any combination thereof. The turbine may include one or more shafts. The one or more shafts may be referred to as a rotor or axle. The one or more shafts may extend along all or a portion of a length of a turbine. The one or more shafts may extend along a longitudinal axis of a turbine. The one or more shafts may be substantially concentric or off-center relative to a longitudinal axis of a turbine. The one or more shafts may be surrounded by, affixed to, or both one or more blades. A plurality of blades may encircle the shaft. The turbine may be an impulse turbine, reaction turbine, or a combination of both. The blades may be designed for an impulse turbine, reaction turbine, or both. The plurality of blades may be divided into stages. Each stage may have a safe or differing diameter (e.g., length from tip to tip of opposing blades). The blades may be configured to rotate as a steam from input into the turbine passes by. The blades capture are configured to capture as much energy as possible from the steam by spinning the shaft about its axis. The plurality of blades and shaft are stored within a housing. The housing may one or more inlets, outlets, or both. One or more inlets may be affixed to one or more steam lines. One or more steam lines may be affixed to, in fluid communication with, or both one or more reaction chambers, one or more turbines, or both. One or more steam lines may include a single steam line or a plurality of steam lines per reaction chamber. A housing may include a matching number of inlets as the number of reaction chambers within the energy system. The one or more inlets may have a configuration suitable for directing the incoming steam toward the plurality of blades. The one or more inlets may be shaped as nozzles. One or more portions of the turbine may be affixed to one or more components of a power system. For example, a shaft of the turbine may be rotationally connected to a rotor of a generator.

Power System

The present disclosure further relates to a power system. A power system may function to integrate with an energy system, convert mechanical energy (e.g., kinetic) into another form of energy, provide energy to a load, or both. The power system may be affixed to and/or integrated with the energy system. The power system may be suitable for providing energy to a variety of loads, including vehicles, facilities, power plants, power grids, the like, or a combination thereof. The power system may be attached to a load. The power system may include one or more generators, motors, fuel cells, steam condensers, or a combination thereof.

A power system may include one or more generators. One or more generators may function to receive mechanical energy from an energy system, convert mechanical energy into electrical energy, or both. One or more generators may have any size, shape, and/or configuration for receiving and converting mechanical energy from an energy system into electrical energy, outputting electrical energy to a motor, or both. The one or more generators may be in direct or indirect communication with a turbine of an energy system. The one or more generators may be adjacent, affixed, or both to one or more turbines of an energy system. The one or more generators may be rotationally engaged with one or more turbines. A generator may include a rotor. The rotor may be rotationally affixed to the shaft of a turbine. A generator may be part of a motor-generator unit. A suitable generator may be that as disclosed in U.S. Pat. No. 8,723,382, incorporated herein by reference in its entirety for all purposes. A generator may be in electrical communication with a motor. A generator may be in communication with a motor via one or more shafts, electronic controller boards, electrical connections, power converters, voltage converters, power inverters, or any combination thereof.

A power system may include one electrical connectors. The one or more electrical connectors may function to allow an electrical energy from one or more generators to be transferred to one or more motors, loads, or both. The power one or more electrical connectors may have any size and configuration to transfer electrical energy from one or more generators to one or more motors, loads, or any combination thereof. The one or more electrical connectors may be in electrical communication with one or more generators, motors, loads, power converters, voltage converters, power inverters, or a combination thereof. One or more electrical connectors may include one or more cords, power transfer systems (e.g., transfer switch), the like, or a combination thereof. One or more electrical connectors may include a 110V electrical connector, 220V electrical connector, or both. The one or more electrical connectors may include a shore power adapter, plug, outlet, USB outlets, the like, or any combination thereof. One or more electrical connectors may be in the form of one or more electrical pigtails. One or more electrical connectors may cooperate with one or more power converters, voltage converters, power inverters, or a combination thereof to provide a continuous current, alternating current, or both. The one or more electrical connectors may directly electrically connect a generator to a motor, load, or a combination thereof.

A power system may include one or more motors. One or more motors may function to convert electrical energy into a form of mechanical energy; convert electricity into motion, rotational motion, or both; output torque based from an electrical input; or a combination thereof. The one or more motors may be any motor suitable for cooperating with a generator of the power system, providing a source of energy to a load, or both. The one or more motors may be a direct current motor, alternating current motor, or both. The motor may be brushed, brushless, or both. The one or more motors may be single phase, two-phase, three-phase, or a combination thereof. The one or more motors may be liquid-cooled, air-cooled, or both. The one or more motors may be a motor as disclosed in U.S. Pat. No. 8,723,382 incorporated herein. In the instance the load is a vehicle, the motor may be affixed to or in communication with a drivetrain of the vehicle. For example, a motor may be in communication with a transmission of a vehicle.

The power system may include one or more fuel cells. The one or more fuel cells may function to store energy from an energy system, release energy to a load, or both. One or more fuel cells may have any size, shape, and/or configuration to store and controllably release energy from one or more turbines. The one or more fuel cells may in communication with one or more turbines. One or more fuel cells may be connected to one or more emissions lines. One or more emissions lines may be connected to one or more outlets of a housing of a turbine, one or more inlets of one or more fuel cells, or both. The one or more emissions lines may collect one or more gasses within the turbine, not converted into rotational motion of the shaft, or both. The one or more emissions lines may receive hydrogen from the turbine. The hydrogen may result from the reaction within the reaction chamber. The hydrogen may function to react with oxygen within the fuel cell to create electricity. The one or more fuel cells may be one or more hydrogen fuel cells. The one or more fuel cells may include one or more polymer electrolyte membrane fuel cells, direct methanol fuel cells, alkaline fuel cells, phosphoric acid fuel cells, molten carbonate fuel cells, solid oxide fuel cells, reversible fuel cells, the like, or a combination thereof. The one or more fuel cells may reside with a housing. A fuel cell housing may be impact resistant to provide protection to the one or more fuel cells. A fuel cell housing may be located in proximity to or distanced from one or more generators, turbines, or both. For example, a fuel cell housing may be mounted to the housing of a turbine. The fuel cell may be affixed to a plurality of electrical lines. The plurality of electrical lines may function to electrically connect the fuel cell to one or more loads, portions of the power system, portions of an energy system, or any combination thereof. In the instance the load is a vehicle, the one or more electrical lines may be connected to a plurality of vehicle components, such as engine compartment and/or in-cabin electronics.

The power system may include one or more steam condensers. The one or more steam condensers may function to cool a steam back into liquid form. The one or more steam condensers may cool steam generated from an exothermic reaction back into a liquid useful for reuse for a subsequent exothermic reaction. The steam condenser may have any suitable shape, size, and/or configuration for cooling steam and transforming back into a liquid phase. The steam condenser may include a condenser housing, one or more inlets, one or more outlets, one or more heat exchangers, or any combination thereof. The condenser housing may have a shape which is substantially cylindrical, cubical, cuboidal, conical, pyramidical, spherical, hemispherical, prismed, the like, or any combination thereof. The shape of the condenser housing may be selected based upon the available packaging space. Located within the condenser housing may be one or more heat exchangers. One or more heat exchangers may function to cool steam passing by such that the steam transforms back to a liquid phase. The one or more heat exchangers may include any suitable heat exchanger configuration for resulting in a phase-change. The one or more heat exchangers may include one or more tubes therein. The one or more tubes may include a cooling fluid. The cooling fluid may circulate through the one or more tubes as steam passes by. The tubes and cooling fluid function to cool the steam and condense it into a liquid. The one or more tubes may be in communication with one or more radiator lines. One or more radiator lines may include one or more incoming radiator lines, outgoing radiator lines, or both. One or more radiator lines may function to receive a cooled fluid (e.g., radiator fluid), transfer a heated fluid (e.g., radiator fluid), or both. One or more radiator lines may be affixed to one or more inlets, outlets, or both of the condenser housing. The condenser housing may include one or more inlets, outlets, or both. The steam condenser may be in fluid communication with one or more radiators, turbines, water pumps, water sources, or any combination thereof. The steam condenser may be in fluid communication with one or more turbines, radiators, or both via one or more steam lines. One or more steam lines may be located near or at an inlet, outlet, or both of a radiator. One or more steam lines may be affixed to an outlet, inlet, or both of a steam condenser. Steam may travel to and/or from a steam condenser to a radiator for cooling. One or more steam lines may be located near or at an outlet of a turbine. One or more steam lines may be affixed to one or more inlets of a steam condenser. Steam which passes by a plurality of the blades of the turbine may be collected and transferred by one or more steam lines, transmitted to a steam condenser, or both. The steam condenser may be in fluid communication with one or more water pumps, water sources, or both via one or more water lines. The steam condenser may have one or more outlets. One or more water lines may be affixed to one or more outlets of a steam condenser. One or more water lines may connect one or more outlets of a steam condenser to one or more inlets of a water source. One or more water lines connected to a steam condenser may include one or more incoming water lines.

Power Load

The energy system and power system as disclosed herein may be beneficial for providing electrical energy to one or more loads. A load may be any load capable of receiving electrical energy, mechanical energy, or both as an input. A load capable of receiving electrical energy as an input may be in electrical communication with the energy system, power system, or both. A load may be in direct and/or indirect electrical communication with one or more generators. A load capable of receiving mechanical energy as an input may be in communication with the energy system, power system, or both. A load may be in direct and/or indirect communication with one or more turbines, motors, or a combination thereof. A load may be any vehicle, equipment, facility, power plant, power grid, another type of alternative energy system, or any combination thereof. Equipment may include manufacturing equipment, farm equipment, construction equipment, medical equipment, laboratory equipment, office equipment, the like, or a combination thereof. A facility may include a residential building, commercial building, the like, or a combination thereof. A residential building may include a house, condominium complex, apartment complex, dormitory, the like, or any combination thereof. A commercial building may include a hospital, school, office space, retail venue, restaurant, hotel, sports facility, factory, warehouse, communication tower (e.g., cellular tower), light tower, the like, or any combination thereof. Alternative energy may include a back-up generator, solar power system, wind energy system, water energy system, the like, or a combination thereof. For example, the one or more energy systems, power systems, or both may be compatible with one or more energy storage areas of an alternative energy system.

Vehicle

The energy system and power system as disclosed herein may be beneficial for use within a vehicle. A vehicle may include a land-based vehicle, watercraft, aircraft, recreational vehicle (RV), camping trailer, the like, or any combination thereof. A land-based vehicle may include a motorcycle, car, truck, bus, train, or the like. An aircraft may include an airplane, helicopter, or the like. A watercraft may include a ship, boat, jet-ski, submarine, the like, or a combination thereof. A vehicle may be defined by a front opposing a rear. The vehicle may have an exterior which defines both an engine compartment and a vehicle interior. A vehicle exterior may include one or more exterior features of the vehicle. One or more exterior features may include one or more mirrors (e.g., side view mirrors), lights (e.g., headlights, taillights), windows, wipers, the like, or any combination thereof. The engine compartment may be located within a front or rear portion of the vehicle. Typically, the engine compartment is located within the front of the vehicle. The vehicle interior may include passenger driving components (e.g., steering wheel, pedals, shifter), seating, dashboard, interior mirrors, heating and air conditioning controls and vents, additional in-cabin electronics, the like, or a combination thereof. The vehicle may rely on a drive train affixed to an energy and power system for propulsion.

The vehicle may include a drivetrain. The drivetrain may function to deliver power from one or more power systems to one or more wheels of the vehicle. The drivetrain may have any configuration for resulting in power delivery to wheels of a vehicle. The drivetrain may include one or more transmissions, driveshafts, axles, differentials, wheels, the like, or a combination thereof. A transmission may function to adapt the output of a power system to input for a driveshaft. The transmission may function to adapt torque from a motor into torque for a driveshaft. The transmission may be connected to both a motor and a driveshaft. The transmission may include a plurality of gears and gear trains to provide speed and torque conversions from the torque from the motor to torque for the driveshaft. A transmission may be located within an engine compartment, vehicle underbody (e.g., chassis), rear of the vehicle, or a combination thereof. The torque of a driveshaft is transferred to one or more axles of the drivetrain. The torque of the driveshaft may be output to a front axle, rear axle, or both. The torque of the driveshaft may be received by one or more differentials. The one or more differentials may function to convert the torque or power from the driveshaft into a rotational input for one or more axles. The one or more axles may then transfer the rotational input to one or more wheels. The wheels may further be controlled by a steering system.

The vehicle may include a steering system. The steering system may function to control steering of the vehicle. The steering system may have a configuration typically used in vehicles. The steering system may include a steering wheel, steering column, power steering, the like, or a combination thereof. A steering wheel may reside within an interior of the vehicle, be connected to a dashboard, or both. The steering wheel may include one or more buttons and/or switches for controlling one or more features of the vehicle, such as in-cabin electronics. The steering wheel may be in electrical communication with a power system for receiving an electrical signal. The steering wheel may be in electrical communication with one or more fuel cells. The steering wheel may be attached to a steering column. The steering column may function connect the steering wheel to the power steering. The steering column may pass from within the vehicle interior to the engine compartment. The power steering may function to augment steering effort on a steering wheel to ease the physical effort required to turn one or more wheels of the vehicle. The power steering may be any type of suitable power steering. The power steering may include hydraulic steering, electro-hydraulic steering, electric steering, or a combination thereof. The power steering may be in electrical communication with one or more power systems. The power steering may be in electrical communication with one or more fuel cells.

The vehicle may include a radiator. The radiator may function as a heat exchanger, transfer thermal energy from one medium to another for the purpose cooling and heating, or both. The radiator may have any configuration suitable for cooling one or more components, fluids, or both of an energy system, power system, vehicle, or a combination thereof. The radiator may have a configuration substantially similar to a radiator design used in engine compartments of vehicles to cool internal combustion engines. A radiator may have a cross flow design, down flow design, or both. The radiator may include one or more inlets, outlets, tanks, radiator cores, fans, or a combination thereof. A radiator core may include a plurality of rows. The rows may be defined by tubes of the radiator core. The radiator may include a plurality of fins. The fins may partially or substantially surround the tubes. The tubes may function to transport a radiator fluid from an inlet to an outlet. The plurality of fins may function to transfer heat from a stream flow passing the radiator core to the radiator fluid, from the radiator fluid to the ambient air, or both. For example, as unused steam passes by the radiator core, the heat from the steam may transfer to the radiator fluid within the tubes with the aid of the plurality of fins. The steam is thus cooled and may start to transition from steam to a liquid phase. A fan may function to increase air flow away from the radiator, expediting heat transfer with the radiator core, or both. A fan may be affixed to any portion of the radiator suitable for increasing air flow away from the radiator core. A fan may be affixed to the radiator core. The fan may receive torque from a fan motor. The fan motor may be an electric motor. The fan motor may be in electrical communication with a power system. The fan motor may electrically connected to one or more fuel cells. The radiator may have one or more steam lines, radiator fluid lines, coolant tubes, or a combination thereof affixed thereto. The radiator may be connected to one or more steam condensers, heating systems, or both.

The vehicle may include a heating system. The heating system may function to heat the vehicle interior such that it is comfortable for a passenger. The heating system may have any suitable configuration for heating the vehicle interior. The heating system may include a heater core, ducts, a blower, or any combination thereof. A heater core may be located between an engine compartment and a vehicle interior, within a dashboard, or both. A heater core may function as a radiator, heat exchanger, or both to heat an interior of the vehicle, such as the passenger compartment. The heater core may have a plurality of tubes which form the heater core. The plurality of tubes may be in fluid communication with one or more radiator fluid lines, a radiator, or both. A radiator fluid may be transmitted from a radiator to a heater core via one or more radiator fluid lines. The radiator fluid may be heated from the heat exchange process within the radiator, from steam from a turbine, or both. A heater core may be located between one or more blowers and one or more ducts. The heater core may be located upstream of one or more ducts and downstream of one or more blowers. The blower may function to flow air through one or more ducts, across one or more heater cores, or both. The blower may be in electrical communication with a power system. The blower may be electrically connected to one or more fuel cells, allowing the blower to receive electricity. As air passes by one or more heater ducts, the heat from one or more heater cores is transferred to the stream of air. Thus, the heating system may cooperate with both a power system and energy system to use leftover thermal energy, such as in the form of steam, to heat an interior of the vehicle.

The vehicle may include a cooling system. The cooling system may function to cool a vehicle interior such that it is comfortable for a passenger. The cooling system may have any suitable configuration for cooling of the vehicle interior. The cooling system may function as a typical air conditioning system. For example, the cooling system may include a condensing coil, expansion valve, evaporator, and an air conditioning compressor; the cooling system may rely on a refrigerant; the cooling system may rely on air flow from a vehicle's movement; or a combination thereof. The cooling system may include an air conditioning compressor, compressor housing, one or more ducts, or a combination thereof. One or more ducts of a cooling system may be shared with one or more ducts of a heating system. One or more components of the cooling system may be located within an engine compartment, vehicle interior, dashboard, or a combination thereof. The air conditioning compressor may be in electrical communication with a power system. The air conditioning compressor may be electrically connected to one or more fuel cells. Thus, the cooling system may cooperate with a power system and energy system to power an air conditioning compressor.

Method of Creating Thermal Energy and Converting to Another Form of Energy

The disclosure further relates to a method for creating energy with the energy system disclosed herein. The method may comprise the steps of: a) dispensing a catalyst into one or more reaction chambers for creating an exothermic reaction with water to generate heat; b) introducing a portion of the heat into a heat storage medium adapted to store thermal energy; c) generating steam from the combination of a presence of heat stored within the heat storage medium, the water, and the catalyst; and d) dispensing the steam at a pre-determined pressure to convert the steam into mechanical energy.

The method may include a step of dispensing a catalyst. The catalyst may be dispensed into one or more reaction chambers to react with one or more liquids also located within the reaction chamber. The catalyst may be dispensed from one or more catalyst sources into the one or more reaction chambers. One or more valves may control the flow of one or more catalysts into one or more reaction chambers. For example, one or more valves of one or more reaction chamber may allow and/or prevent passage of one or more catalysts from one or more catalyst sources. The catalyst may be dispensed when a pressure within a reaction chamber is below a certain pressure level; thermal energy is required by a power system or load; or a combination thereof. A catalyst may be dispensed into a reaction chamber when the pressure in the reaction chamber below about 500 kPa or greater, about 1,000 kPa or greater, about 2,000 kPa or greater, or even about 2,400 kPa or greater. A catalyst may be dispensed into a reaction chamber when the pressure in the reaction is about 7,000 kPa or less, about 6,000 kPa or less, or even about 5,000 kPa or less. Dispensing of the catalyst may occur before, at the same time, or after dispensing of one or more liquids, heat storage mediums, or both into the reaction chamber or any combination thereof. For example, catalysts may be dispensed into the reaction chamber at the same time as or after a liquid is dispensed into the reaction chamber and before one or more heat storage mediums are inserted into the chamber. The contact between a catalyst and the liquid may result in an exothermic reaction. For example, dispensing of aluminum nanoparticles into water may result in a rapid exothermic reaction generating hydrogen gas. Methods of generating hydrogen gas from water with aluminum particles are discussed in U.S. Pat. No. 9,011,572, incorporated herein by reference in its entirety for all purposes. The resulting reaction between the catalyst and liquid may be exothermic due to the high heat resulting from the reaction which results in significant local heating within the reaction chamber. The heat of the reaction may result in some of the unreacted liquid transforming into a steam.

The method may include introducing one or more heat storage mediums into a reaction chamber. Introduction of the heat storage mediums may allow heat from the reaction to be retained. The method may include any suitable form for dispensing one or more heat storage mediums into the one or more reaction chambers. The method may include activating one or more actuators to insert one or more tubes into one or more reaction chambers. The one or more actuators may be activated by one or more motors. The one or more motors may receive an electrical signal from one or more fuel cells. The method may include inserting one or more tubes containing one or more heat storage mediums into one or more reaction chambers. The heat storage medium may include zeolite. The one or more heat storage mediums may be introduced into one or more reaction chambers before, during, or after an exothermic reaction has occurred within a reaction chamber. The one or more heat storage mediums may be introduced to preserve the heat, elevated temperature, or both resulting from an exothermic reaction within the reaction chamber.

The method may include introducing heat into a heat storage medium. The introduction of the heat into a storage medium may function to preserve the heat generated from the exothermic reaction within the reaction chamber for a longer duration than relying on the reaction chamber itself. In other words, the heat storage medium improves the heat transfer properties of the reaction chamber. Heat may be introduced into a heat storage medium in the form of steam particles. The steam particles may be attracted to a surface of a heat storage medium, a plurality of cavities of the storage medium, or both. For example, particles of water from the steam may be trapped inside a plurality of pores of zeolite. The one or more heat storage mediums may be able to store the thermal energy (e.g., heat) of the particles for an indefinite amount of time, without energy loss, or both. Thus, the heat storage mediums may function to further heat the interior of the reaction chamber.

The method may include generating steam from the presence of heat. The generation of steam may function to build-up a steam pressure within the reaction chamber, create sufficient thermal energy to power a turbine, or both. The steam may be a result of the elevated temperatures resulting from the exothermic reaction, the heat stored within one or more heat storage mediums, or both. The steam may be generated from liquid which has not yet reacted with one or more catalysts. The steam may be pressurized within a reaction chamber. One or more pressurizing features may be activated within a reaction chamber. For example, one or more spring plates may compress the steam such as to further pressurize the steam to a desired pressure amount. The steam may be pressurized to about 500 kPa or greater, about 1,000 kPa or greater, about 2,000 kPa or greater, or even about 2,400 kPa or greater. The steam may be pressurized to about 7,000 kPa or less, about 6,000 kPa or less, or even about 5,000 kPa or less. Once the steam achieves a desired pressure level, the steam may be dispensed from the reaction chamber.

The method may include dispensing of steam. Dispensing of steam may allow for the thermal energy to be converted into another energy form, gasses to be collected and utilized, steam to be recycled, or a combination thereof. Dispensing of steam may occur once the steam reaches a desired pressure level. Dispensing of steam may include dispensing steam from one or more reaction chambers to one or more turbines. Dispensing of steam may include transferring steam via a single or a plurality of steam lines into a turbine. Dispensing of steam may include receive steam via one or more inlets. One or more inlets may be part of a turbine. One or more inlets may include one or more nozzles.

The disclosure relates to a method for converting thermal energy into mechanical energy. Conversion of thermal energy into mechanical energy may allow the energy system to cooperate with a power system, one or more loads, or both to provide an alternative energy source. The thermal energy may be converted into kinetic energy by one or more turbines. One or more nozzles may direct a steam flow toward one or more blades. The blades may then capture as much of the energy from the steam flow as possible. The contact of the steam upon the blades causes the blades to rotate. Rotation of the blades may cause rotation of a shaft of a turbine. The rotation of the shaft is kinetic energy that is adaptable for integration with one or more power systems, loads, or both.

The disclosure further relates to a method for converting mechanical energy into electrical energy. Conversion of mechanical energy into electrical energy may allow for the energy system to be integrated with a load which requires an electrical energy input. The kinetic energy may be received by a portion of a power system. The energy system may be affixed to a power system to convert the mechanical energy from a turbine into electrical energy. A turbine may be rotationally attached to a generator, a motor, or both. Rotation of a turbine may result in rotation of a generator. Rotation of a shaft of a turbine may cause rotation of a rotor of a generator. As taught in U.S. Pat. No. 8,723,382, rotation of a rotor of a generator may result in conversion of the torque input (e.g., kinetic energy) into electrical energy.

The method may also include transferring one or more gasses to one or more fuel cells. The one or more gasses may allow for one or more fuel cells to produce electrical energy. During the exothermic reaction, one or more gasses may be generated. For example, hydrogen gasses may be a product of the exothermic reaction. The gasses may be transferred from one component of the energy system to another, from the energy system to the power system, or both. For example, the gasses may be transferred from one or more reaction chambers to one or more turbines. As another example, the gasses may be transferred from a turbine to one or more fuel cells. By receiving the one or more gasses in one or more fuel cells, the one or more gasses may provide one or more reactants within a fuel cell. The one or more reactants may be useful in generating electrical energy from the fuel cell. For example, hydrogen and oxygen may react with anodes and cathodes of the fuel cell to generate electricity.

The method may further include capturing and recycling unused steam. Allowing the steam to be recycled allows for the liquid to be reused within the energy system for a high number of reaction cycles in a reaction chamber without having to refill the energy system with water. The steam which collects in an energy system may transfer to the power system. The steam which collects in a turbine, does not result in motion of a turbine, or both may be transferred to one or more steam condensers, radiators, or both. The steam may travel from a turbine to one or more steam condensers, radiators, or both. The steam may be cooled by one or more steam condensers, radiators, or both. The steam may be cooled to a temperature such that it transforms back to liquid form. The cooled liquid may transfer from a power system to an energy system. The cooled liquid may transfer from a radiator, steam condenser, or both to one or more water sources. The cooled liquid may be transferred from a radiator, steam condenser, or both to one or more water sources via one or more water lines, one or more water pumps, or both. For example, one or more incoming water lines may transfer the cooled liquid to the water sources with the aid of a water pump.

ILLUSTRATIVE EMBODIMENTS

FIG. 1 is a schematic of an energy system 10. The energy system 10 includes a reaction chamber 12. The reaction chamber 12 is connected to a catalyst source 14, water source 16, and heat source 18. Stored within the catalyst source 14 is a catalyst (not shown). An exemplary catalyst may include one or more metallic nanoparticles, such as aluminum nanoparticles. Stored within the water source 16 is water (not shown). Stored within the heat source 18 is a heat storage medium (not shown). An exemplary heat storage medium may include one or more zeolite particles. The catalyst source 14, water source 16, and heat source 18 each feed into the reaction chamber 12. A turbine 22 is connected to the reaction chamber 12. The turbine 22 is downstream of the reaction chamber 22.

Figure 2:
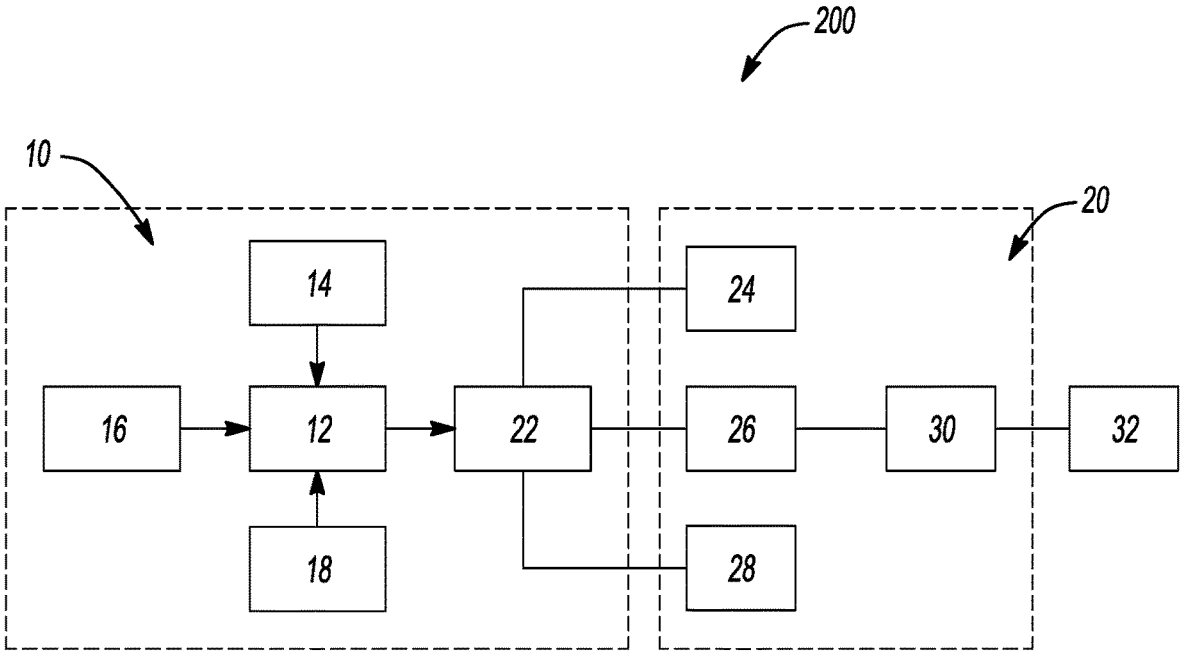
FIG. 2 illustrates a schematic of a vehicle having an energy system integrated with a power system.

FIG. 2 is a schematic of an energy system 10 integrated into a vehicle 200. The energy system 10 includes a reaction chamber 12. Upstream of and connected to the reaction chamber 12 is a catalyst source 14, water source 16, and heat source 18. Downstream of and connected to the reaction chamber 12 is a turbine 22. Downstream of the energy system 10 is a power system 20. The power system 20 is connected to the turbine 22. The power system 20 includes a generator 26. The generator 26 is connected to the turbine 22. The power system 20 includes one or more fuel cells 24. The one or more fuel cells 24 are connected to the turbine 22. The power system 20 includes one or more steam condensers 28. The one or more steam condensers 28 are connected to the turbine 22. Downstream of and connected to the generator 26 is a motor 30. The motor 30 is connected to a drivetrain 32 of the vehicle 200.

Figure 3:
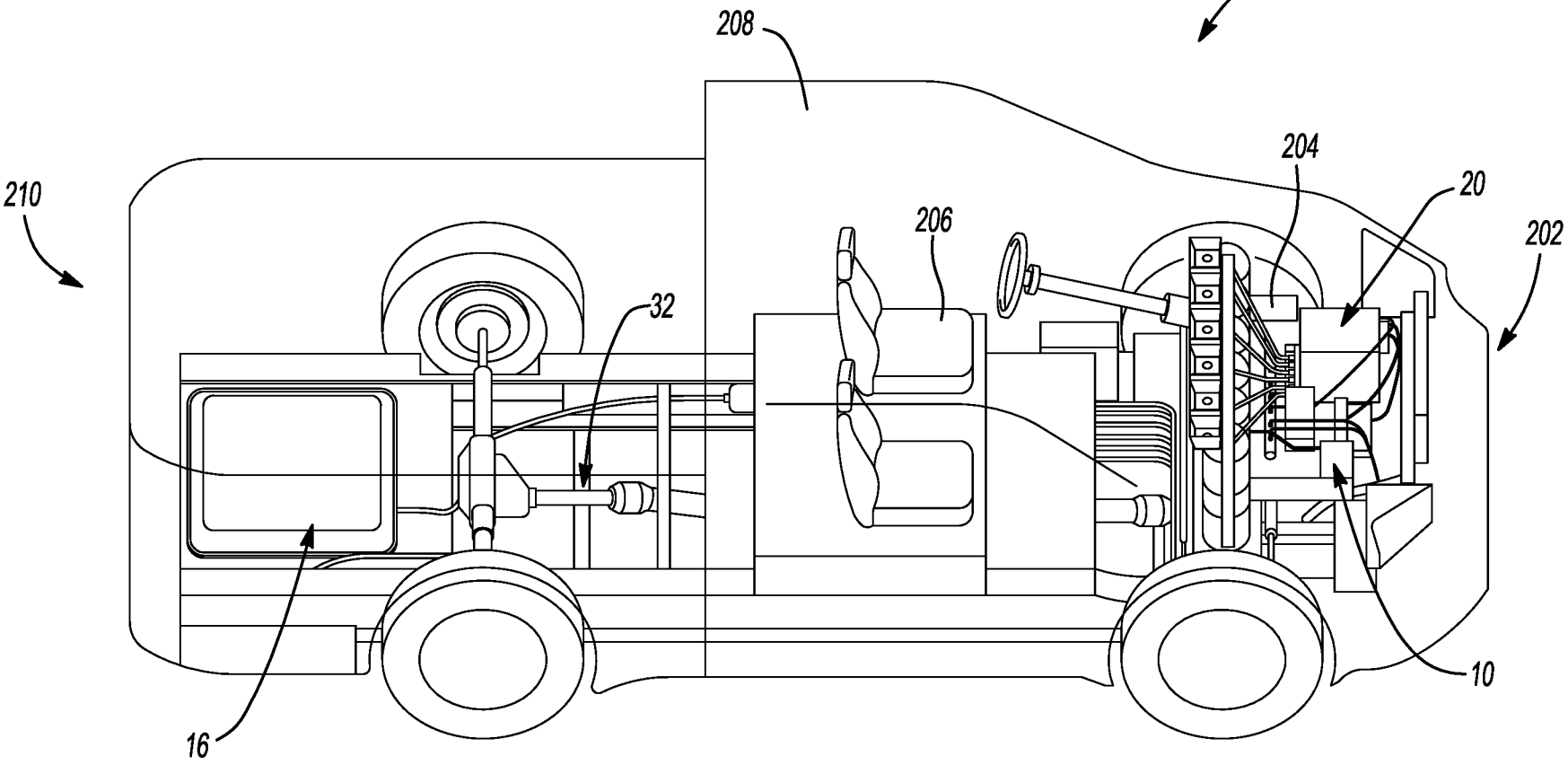
FIG. 3 illustrates a partially transparent view of a vehicle having an energy system connected to a power system therein.

FIG. 3 is a partially transparent view of a vehicle 200 having both the energy system 10 and power system 20 integrated therein. The vehicle 200 has a vehicle exterior 208. Within the vehicle exterior 208 is a vehicle interior 206 and an engine compartment 204. The engine compartment 204 is adjacent to the vehicle interior 206. The engine compartment 204 is located toward the front 202 of the vehicle. The front 202 of the vehicle 200 is opposite the rear 210. A portion of the energy system 10 resides closer to the rear 210 while connected to another portion of the energy system 10 which resides closer to the front 202.

Figure 4:
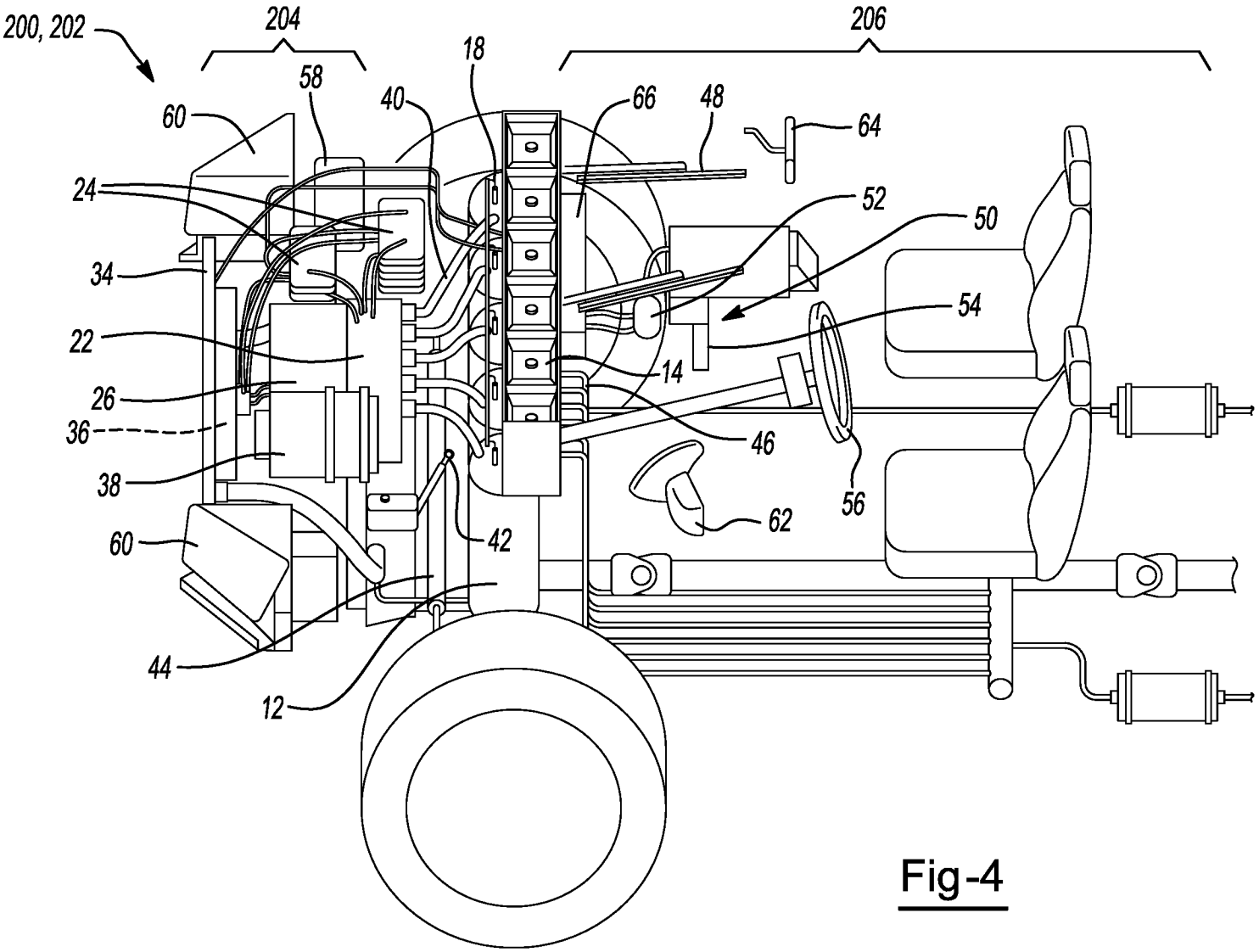
FIG. 4 illustrates a front of a vehicle.

FIG. 4 is a front 202 of the vehicle 200 viewed from above. The front 202 includes an engine compartment 204 adjacent to a vehicle interior 206. The power system 20 of the vehicle 200 is located in the engine compartment 204. A portion of the energy system 10 is also located in the engine compartment 204 of the vehicle 200. The energy system 10 includes a turbine 22. Downstream of and connected to the turbine 22 is a generator 26. The generator 26 is located adjacent to the turbine 22. The connection between the turbine 22 and generator 26 connects the energy system 10 to the power system 20. Downstream of the turbine 22 is a plurality of fuel cells 24. The fuel cells 24 are connected to the turbine 22. Also connected to the turbine 22 are a plurality of steam lines 40. The steam lines 40 are connected to the reaction chamber 12. Upstream of and connected to the reaction chamber 12 is a catalyst source 14. Additionally, upstream of and connected to the reaction chamber 12 is a heat source 18.

The energy system 10 and power system 20 are integrated with a number of typical components of a vehicle 200. Located in the engine compartment 204 is a radiator 34. The radiator 34 includes a fan 36. Also included in the engine compartment 204 is an air conditioning compressor 38, a dipstick 42, and power steering 44. Located in the engine compartment 204 is a washer fluid bottle 58. The washer fluid bottle 58 is connected to windshield wipers 48 located on the vehicle exterior 208. Also located on the vehicle exterior 208 are headlights 60. The exterior 208 also includes a driver side mirror 62.

The energy system 10 also includes an electronic valve control 46. Located in the vehicle interior 206 is heat system 50. The heat system 50 includes a heater core 52 and blower 54. Also, in the vehicle interior 206 is a steering wheel 56 and a rear view mirror 64. The vehicle 200 further includes a central circuit board 66.

Figure 5:
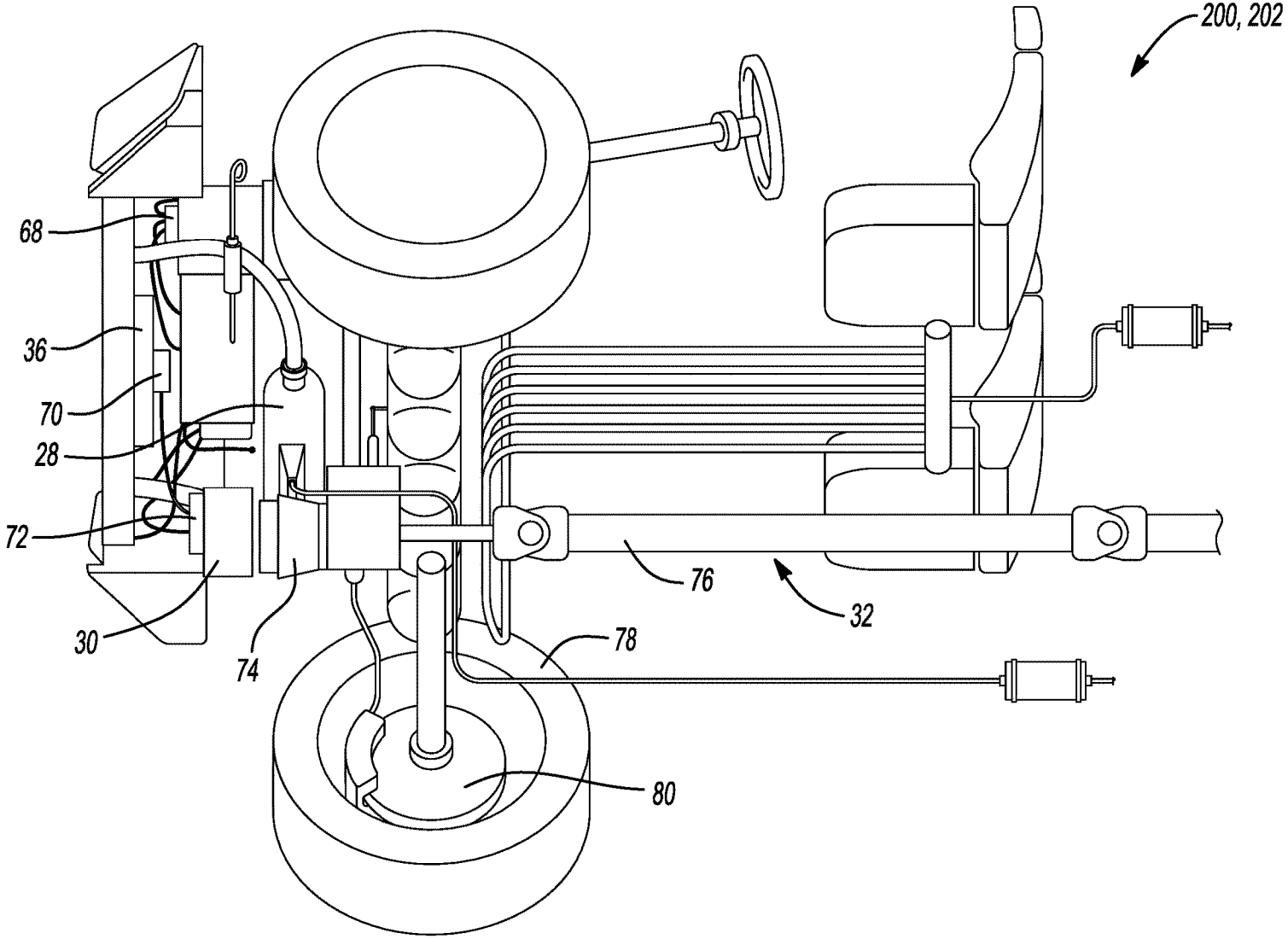
FIG. 5 illustrates a front of a vehicle.

FIG. 5 is a front 202 of a vehicle 200 viewed from below. The front 202 includes a steam condenser 28 in the engine compartment 204. The steam condenser 28 is part of the power system 20. Additionally, a motor 30 is also located within the engine compartment 204. The motor 30 is part of the power system 20. Near the motor 30 there are motor control circuit boards 72. The motor 30 is connected to the drivetrain 32. The drivetrain 32 includes an electronic transmission 74. The electronic transmission 74 is in communication with the driveshaft 76 and wheels 78. The wheels 78 include an anti-lock brake 80. Additionally, located in the engine compartment 204 are coolant tubes 68. The coolant tubes 68 connect the radiator 34 (as shown in FIG. 4) to the steam condenser 28. Located in proximity to the fan 36 is a fan motor 70.

Figure 6:
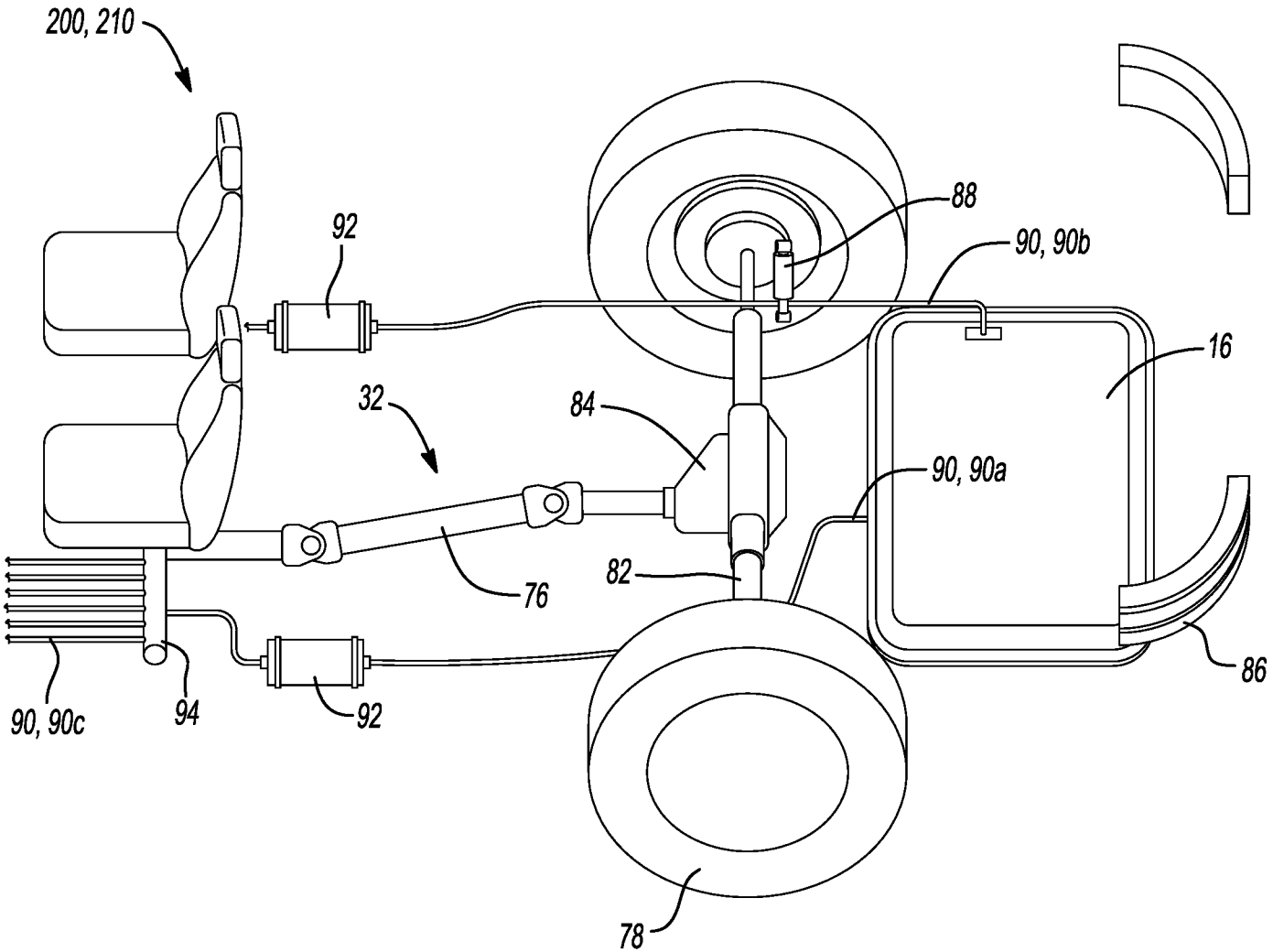
FIG. 6 illustrates a rear of a vehicle.

FIG. 6 is a rear 210 of a vehicle 200 viewed from above. The rear 210 includes the drivetrain 32 extending to wheels 78 in the rear 210. The wheels 78 are in communication with a rear axle 82 having a differential 84. The differential 84 is connected to the driveshaft 76. The drivetrain 32 is also in communication with a suspension 88. Taillights 86 are located on the exterior 208 of the vehicle 200 at the rear 210. A portion of the energy system 10 is located within the rear 210 of the vehicle. The water source 16 is located between the rear axle 82 and the rear 210. The water source 16 is connected to a plurality of water lines 90. The water lines 90 include an outgoing water line 90*a* and an incoming water line 90*b*. The outgoing water line 90*a* is in fluid communication with the reaction chamber 12. The incoming water line 90*b* is in fluid communication with the steam condenser 28. Each of the water lines 90, 90*a*, 90*b* includes a water pump 92. The outgoing water line 90*a* branches out into a multibranch outgoing water line 90*c*. The outgoing water line 90*a* is in fluid communication with a water distributor 94. The water distributor 94 is located between the multibranch outgoing water line 90*c* and a water pump 92 of the outgoing water line 90*a*.

Figure 7:
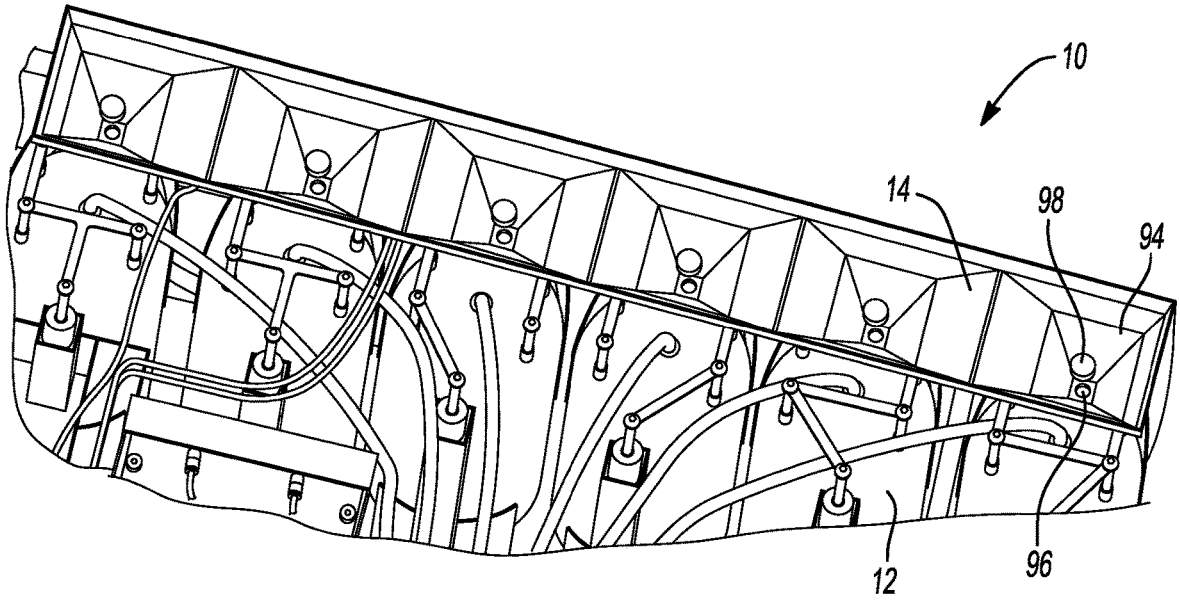
FIG. 7 illustrates a catalyst source and reaction chamber of an energy system.

FIG. 7 is a top plan view of a plurality of catalyst sources 14 of an energy system 10. The catalyst sources 14 are shown without a lid 100 (not shown) such that the interior is exposed. The catalyst sources 14 are located in proximity to a plurality of reaction chambers 12. As an example, six catalyst sources 14 and six reaction chambers 12 are illustrated. Each catalyst source 14 is funnel-shaped 94 such that it tapers toward a reaction chamber 12. The catalyst source 14 includes an opening 96. A reaction chamber valve 98 is located within each opening 96.

Figure 8A:
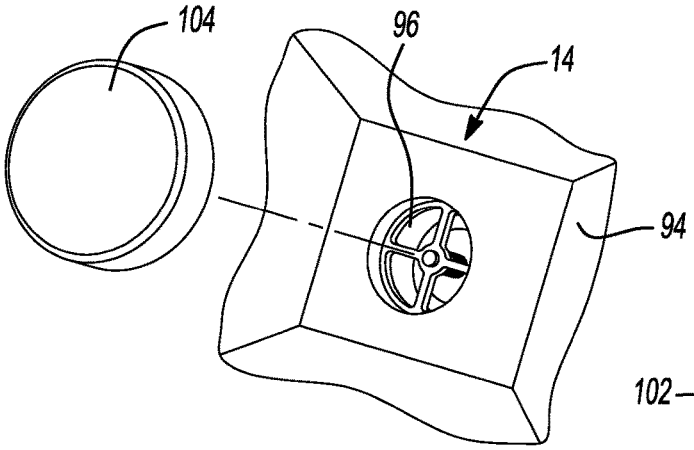
FIG. 8A illustrates a catalyst source.
Figure 8B:
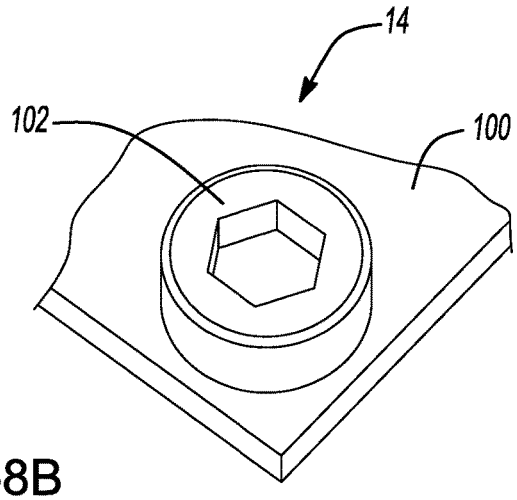
FIG. 8B illustrates a lid closure of a catalyst source.

FIG. 8A is a close-up view of a catalyst source 14 having a funnel-shape 94. FIG. 8B is a close-up view of a lid 100 of the catalyst source 14. The lid 100 is tightly secured via one or more fasteners 102. As an example, a plurality of hex screws may secure the lid 100. The lid 100 includes one or more caps 104. The one or more caps 104 provide access to dispense a catalyst (not shown) into the catalyst source 14.

Figure 9:
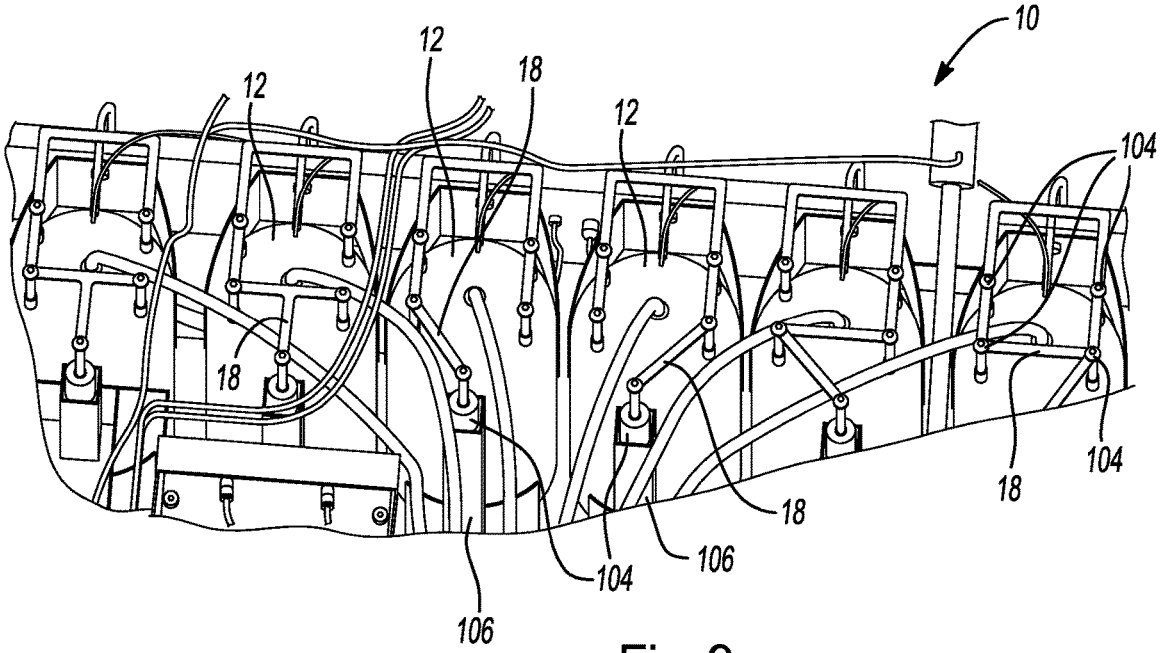
FIG. 9 illustrates a heat source and reaction chamber of an energy system.

FIG. 9 illustrates a plurality of reaction chambers 12. Affixed to the reaction chambers 12 are a plurality of heat sources 18. There is a dedicated heat source 18 per reaction chamber 12. Each heat source 18 is in the form of one or more tubes. Each heat source 18 is in communication with one or more actuators 106. The actuators 106 are in communication with one or more motors 108. The motors 108 activate the one or more actuators 106 such that the heat sources 18 are pushed into the reaction chambers 12. By being pushed into the reaction chambers 12, the heat sources 18 are placed into contact with water (not shown) located therein. The heat sources 18 have caps 104. The caps 104 are removable such that one or more heat storage mediums (not shown) can be located within the heat sources 18.

Figure 10:
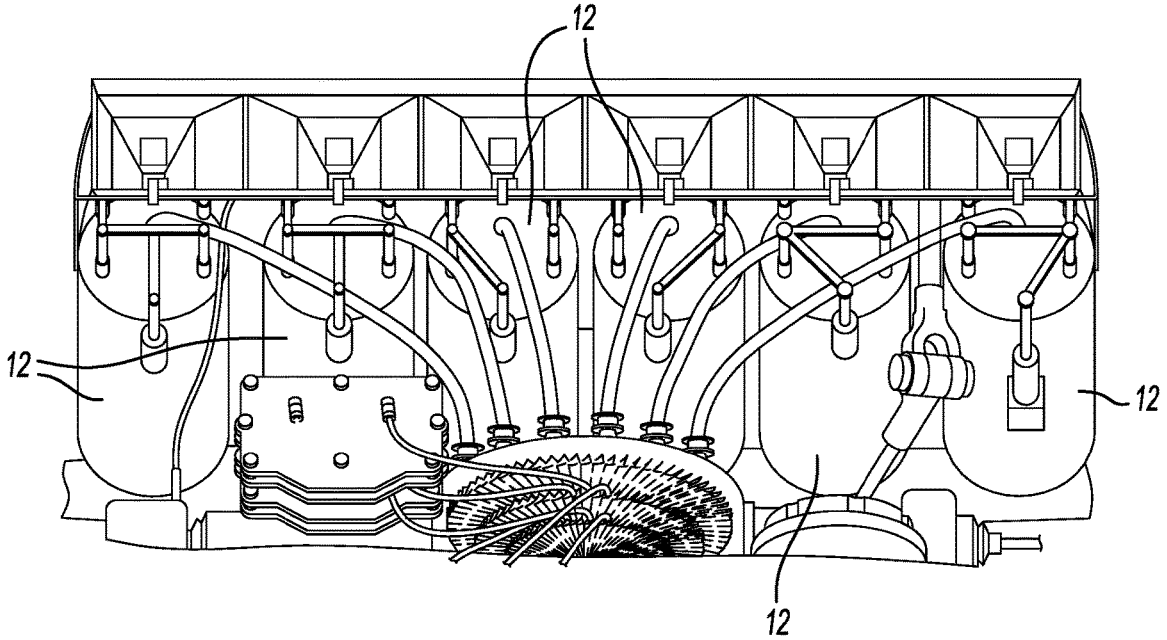
FIG. 10 illustrates a catalyst source, heat source, and reaction chamber of an energy system.

FIG. 10 illustrates a plurality of reaction chambers 12. Within the reaction chambers 12 are spring loaded plates (not shown).

Figure 11:
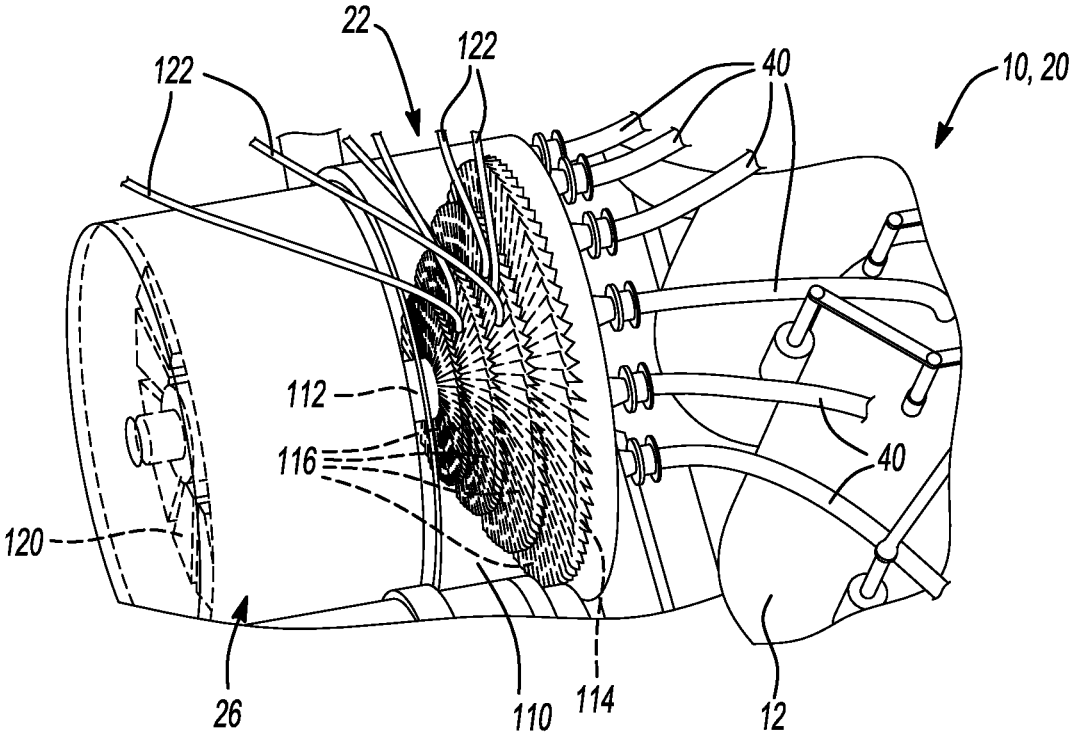
FIG. 11 illustrates a turbine of an energy system connected to a generator of a power system.

FIG. 11 illustrates the turbine 22. The turbine 22 is illustrated as a steam turbine. The turbine 22 includes a housing 110. The housing 110 is shown as transparent to illustrate the interior of the turbine 22. Located within the housing 110 is a shaft 112. About the shaft 112 is a plurality of blades 114. The plurality of blades 114 are divided into stages 116. Each stage 116 has an overall stage diameter with the stage diameter decreasing along the length of the shaft 112 and turbine 22. The turbine 22 is connected to incoming steam lines 40. The incoming steam lines 40 are in fluid communication with both the reaction chambers 12 and the turbine 22. Steam (not shown) within the reaction chambers 12 is received within the turbine 22 and causing its rotation (e.g., blades rotating). The turbine 22 is affixed to the generator 26. The turbine 22 is in rotational communication with the generator 26. A rotor 120 is located within the generator 26. Upon rotation of the turbine 22, the rotor 120 within the generator 26 is also rotated to convert mechanical energy into electrical energy. Additionally, a plurality of outgoing emissions lines 122 are affixed to the turbine 22. The outgoing emissions lines 122 may be able to capture gases, such as hydrogen and oxide, released during the reaction process and which are captured in the turbine 22.

Figure 12:
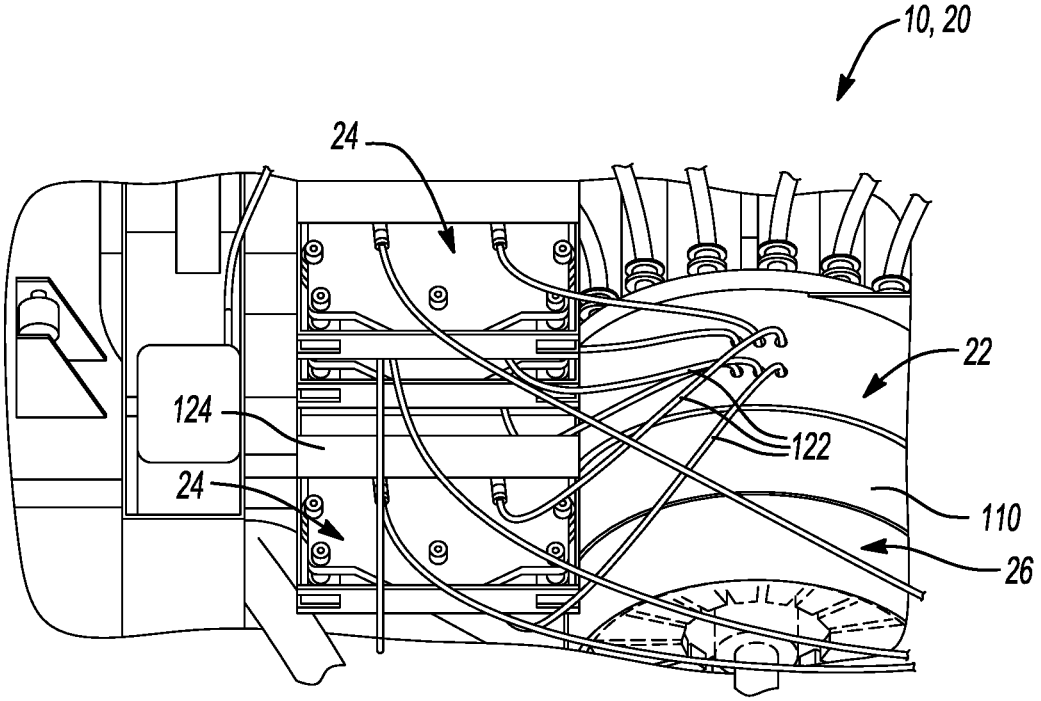
FIG. 12 illustrates a plurality of fuel cells of a power system connected to a turbine of an energy system.

FIG. 12 illustrates a plurality of fuel cells 24. The fuel cells 24 are in fluid communication with the turbine 22 via a plurality of outgoing emissions lines 122. The fuel cells 24 are located adjacent to the turbine 22 and generator 26. The fuel cells 24 are mounted within a fuel cell housing 124. The fuel cell housing 124 is mounted to a housing 110 of the turbine 22.

Figure 13:
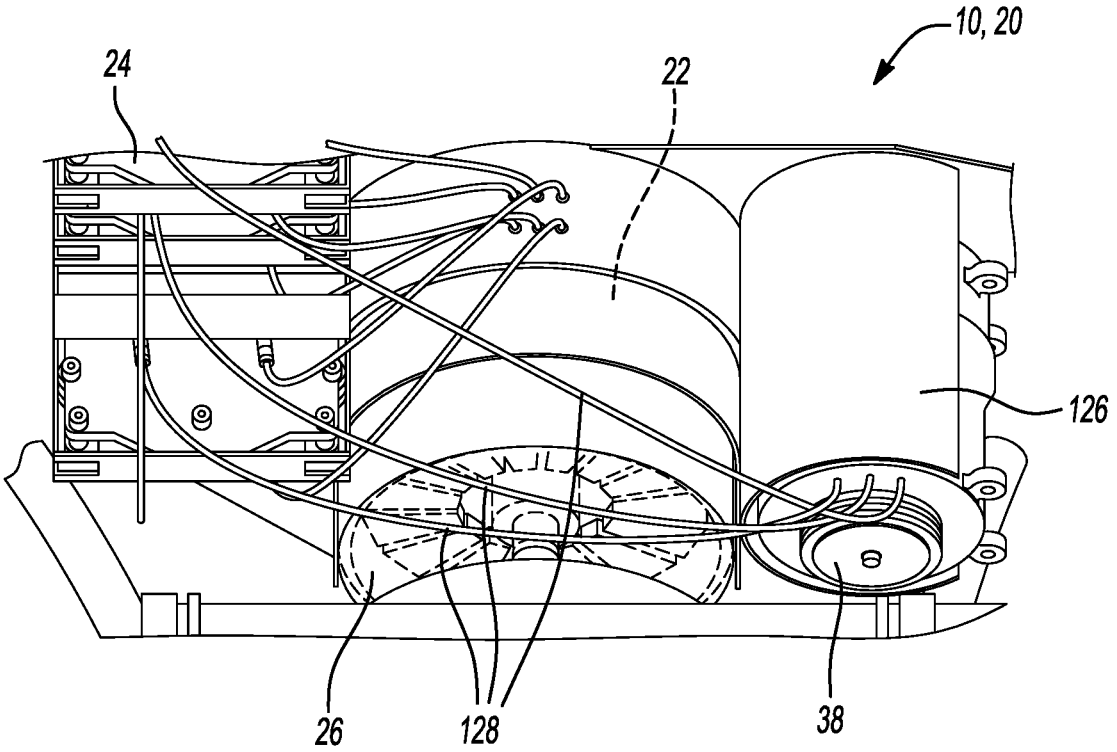
FIG. 13 illustrates an air conditioning compressor of a vehicle in electrical communication with one or more fuel cells of a power system.
Figure 14:
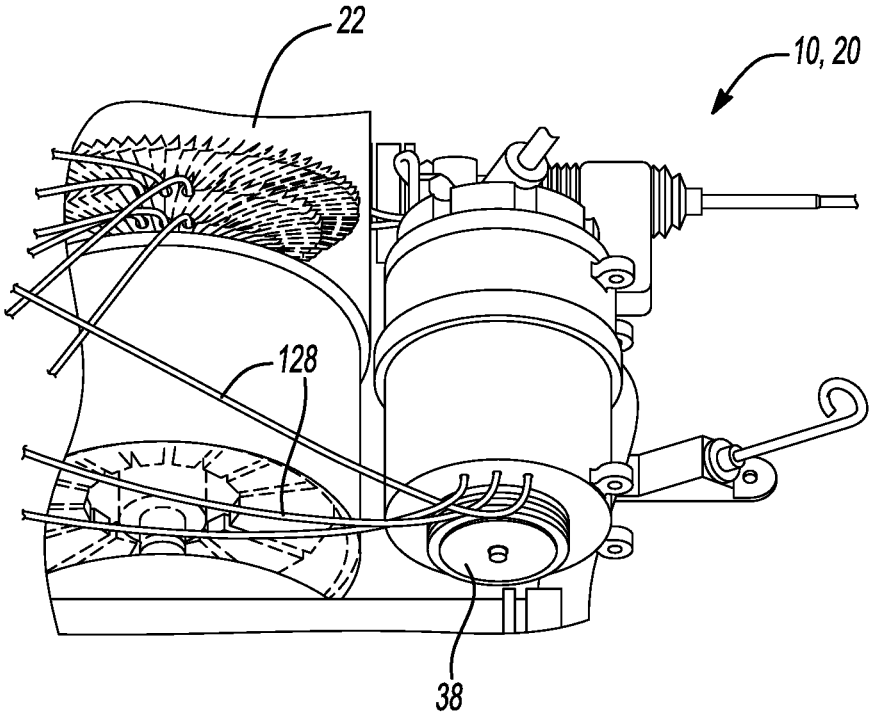
FIG. 14 illustrates an air conditioning compressor of a vehicle.

FIGS. 13 and 14 illustrate an air conditioning compressor 38. The compressor 38 includes a compressor housing 126. The compressor 38 resides within the compressing housing 126. The compressor 38 is located substantially adjacent to both the turbine 22 and generator 26. The compressor 38 is in electrical communication with the fuel cells 24. One or more electrical lines 128 connect the compressor 38 to the fuel cells 24.

Figure 15:
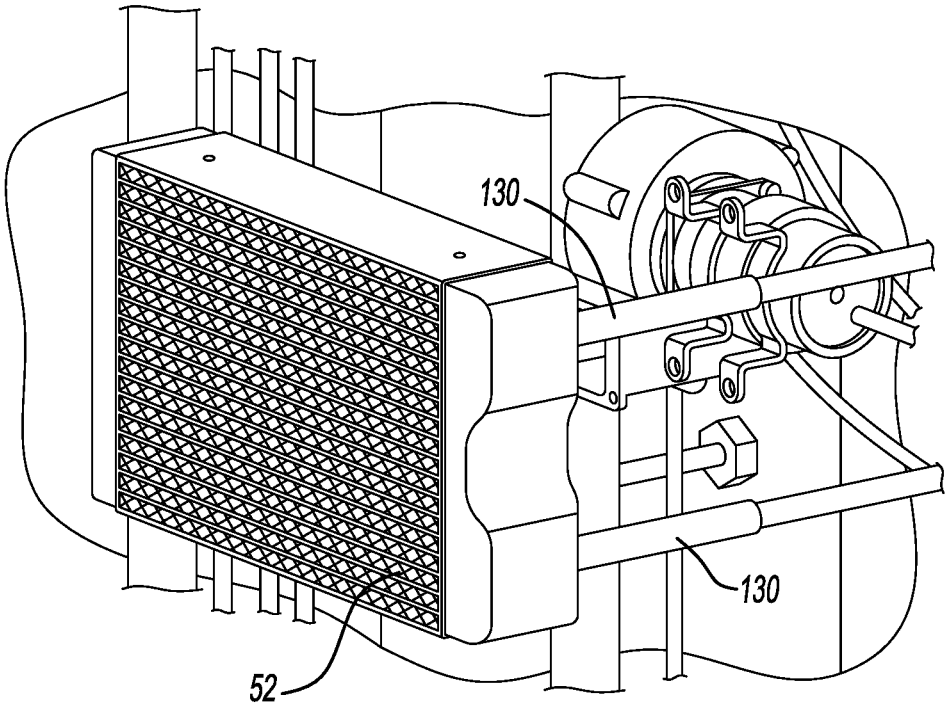
FIG. 15 illustrates a heater core of a vehicle.

FIG. 15 illustrates a heater core 52. The heater core 52 is designed similar to a radiator. The heater core 52 is in fluid communication with the radiator 34 (not shown) via one or more radiator fluid lines 130. The heater core 52 is also in communication with a blower 54 (not shown).

Figure 16:
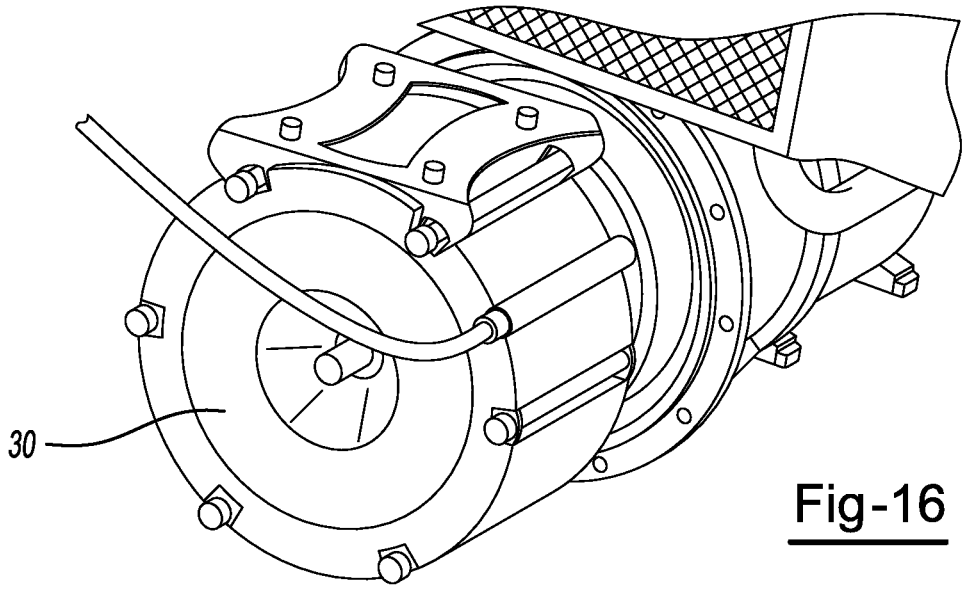
FIG. 16 illustrates a motor of the power system.

FIG. 16 illustrates a motor 30. The motor 30 may be based on the teachings in US 2012/0267974 and U.S. Pat. No. 8,723,382, incorporated herein by reference in their entirety.

Figure 17:
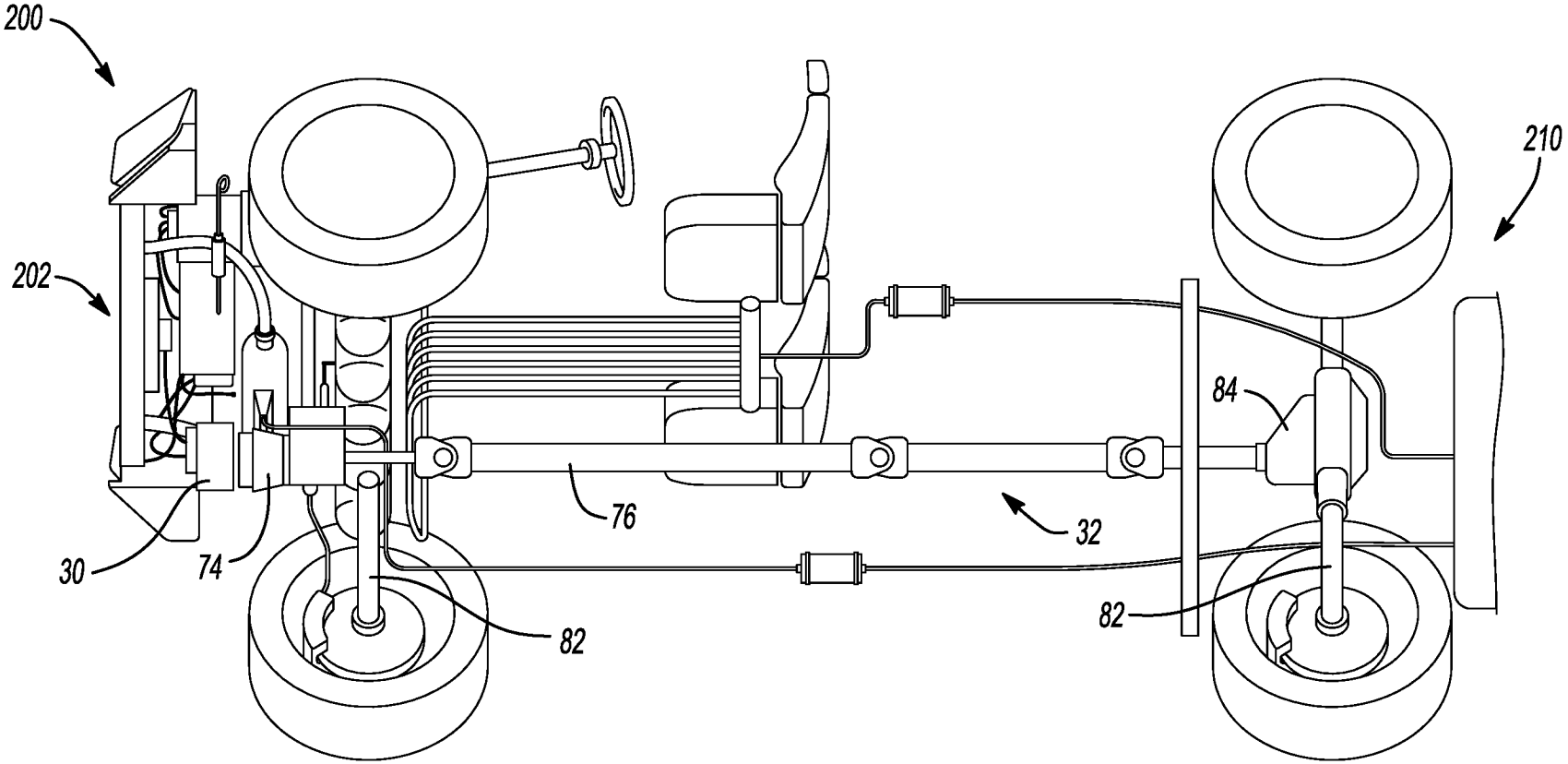
FIG. 17 illustrates a drivetrain connected to a power system of a vehicle.

FIG. 17 illustrates a drivetrain 32 of the vehicle 200. The drivetrain 32 extends from near the front 202 of the vehicle 200 toward the rear 210. The drivetrain 32 includes an electronic transmission 74. The transmission 74 is in communication with the motor 30. The transmission 74 is also connected to a driveshaft 76. The drive shaft 76 is in communication with front and rear axles 82. The rear axle 82 includes a differential 84.

Figure 18:
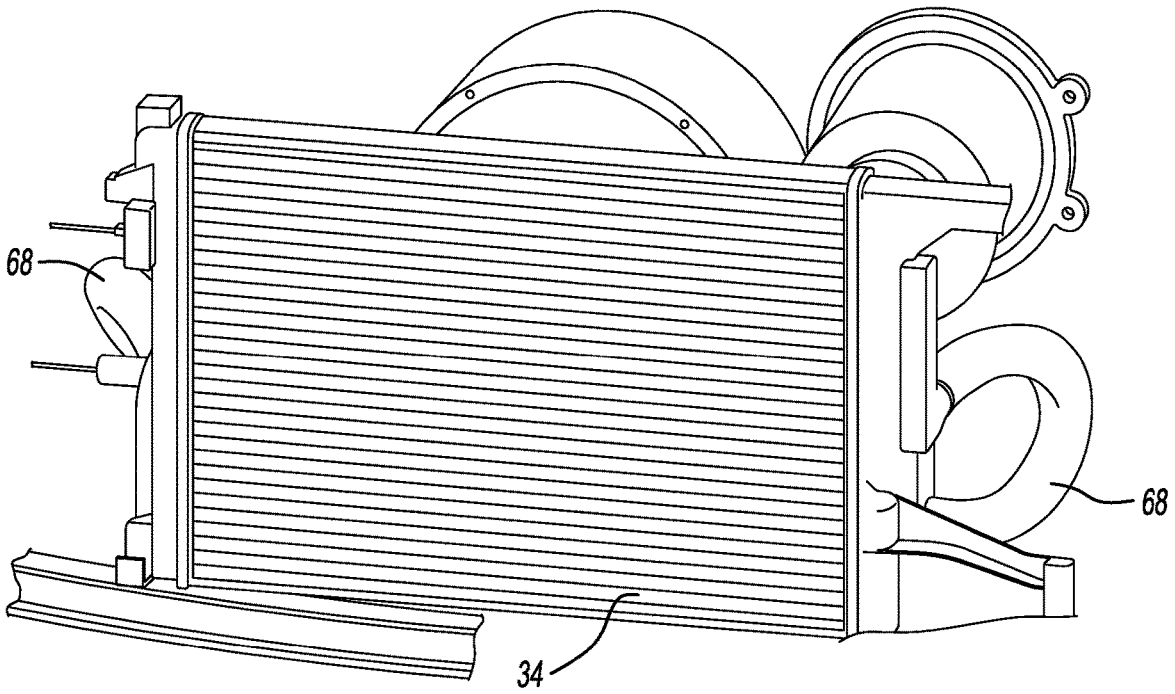
FIG. 18 illustrates a radiator connected to a steam condenser of a power system.
Figure 19:
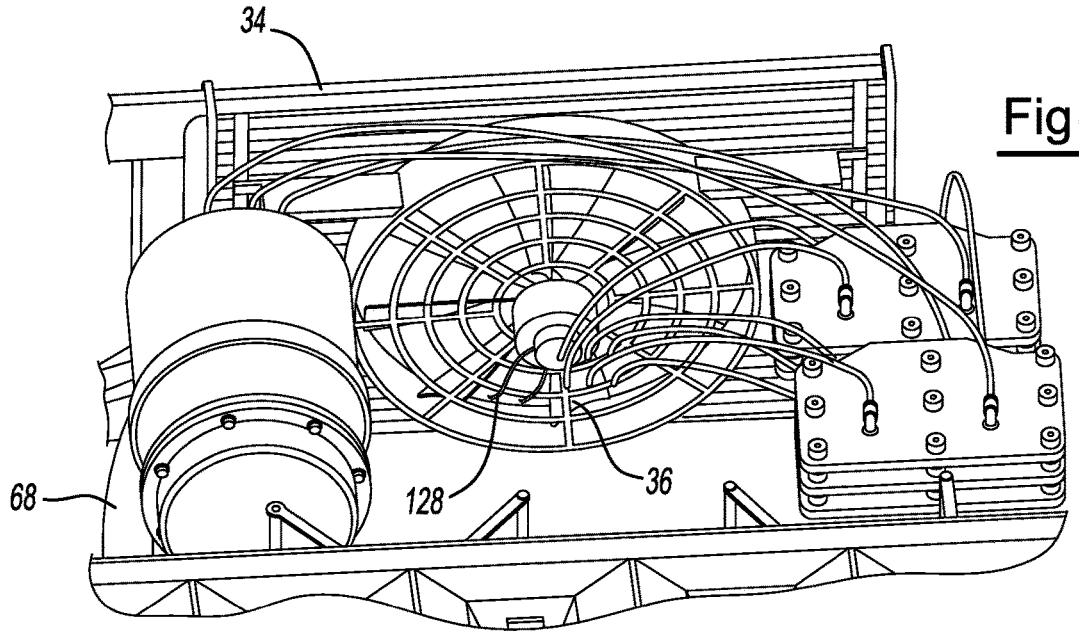
FIG. 19 illustrates a radiator and fan connected to one or more fuel cells of a power system.

FIGS. 18 and 19 illustrate a radiator 34. The radiator 34 is in fluid communication with the steam condenser 28 (not shown) via one or more coolant tubes 68. On the rear side of the radiator 34 is a fan 36. The fan 36 is mounted to the radiator 34. The fan 36 is in electrical communication with the motor control circuit boards 72 (not shown) via one or more electrical lines 128.

Figure 20:
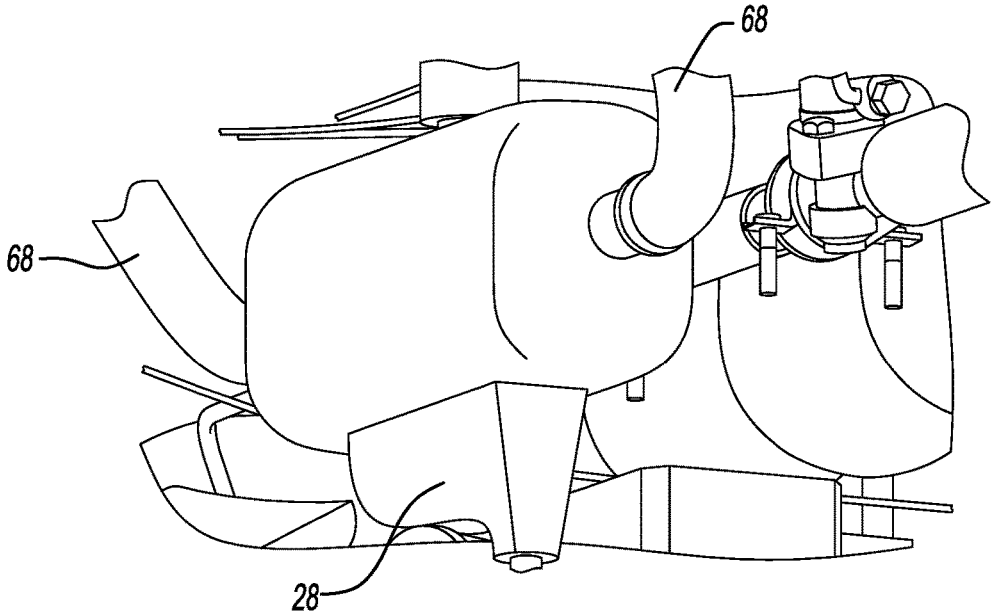
FIG. 20 illustrates a steam condenser of a power system.

FIG. 20 illustrates the steam condenser 28. The steam condenser 28 has one or more coolant tubes 68 affixed thereto. A water line 90 is also connected to the steam condenser 28. The water line 90 is an incoming water line 90*b* which is in fluid communication with the water source 16. The water line 90 may be connected to a water pump 92 (not shown). The incoming water line 90*b* may allow for steam cooled back to liquid form within the steam condenser 28 to flow back to the water source 16.

Figure 21:
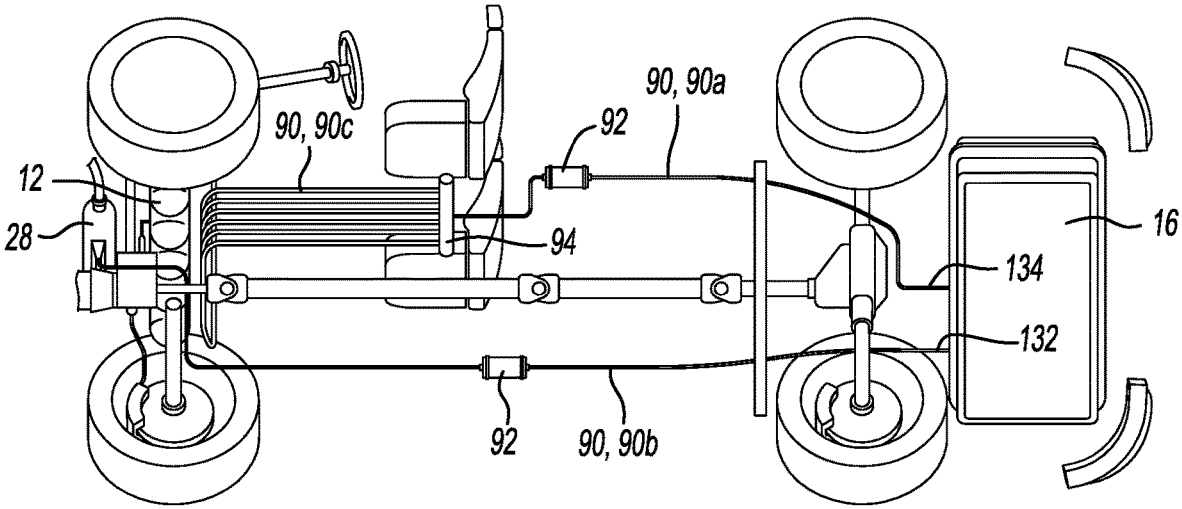
FIG. 21 illustrates a portion of an energy system and attachment to a steam condenser of a power system.

FIG. 21 illustrates the water source 16 and plurality of water lines 90. The water source 16 includes both an inlet 132 and an outlet 134. The water source 16 is in fluid communication with one or more reaction chambers 12 via an outgoing water line 90, 90*a*. The outgoing water line 90*a* is connected to the water source 16 at the outlet 134. The outgoing water line 90*a* is connected to a water distributor 94. The water distributor 94 allows the outgoing water line 90*a* to be divided out into a multibranched outgoing water line 90*c*. Each branch of the multibranched outgoing water line 90*c* is in fluid communication with an individual reaction chamber 12. Located between the outgoing water line 90*a* and multibranched outgoing water lines 90*c* is a water pump 92. An incoming water line 90*b* connects a steam condenser 28 to the water source 16. The incoming water line 90*b* has a water pump 92 along its length. The incoming water line 90*b* is connected to the water source 16 at the inlet 132.

Figure 22:
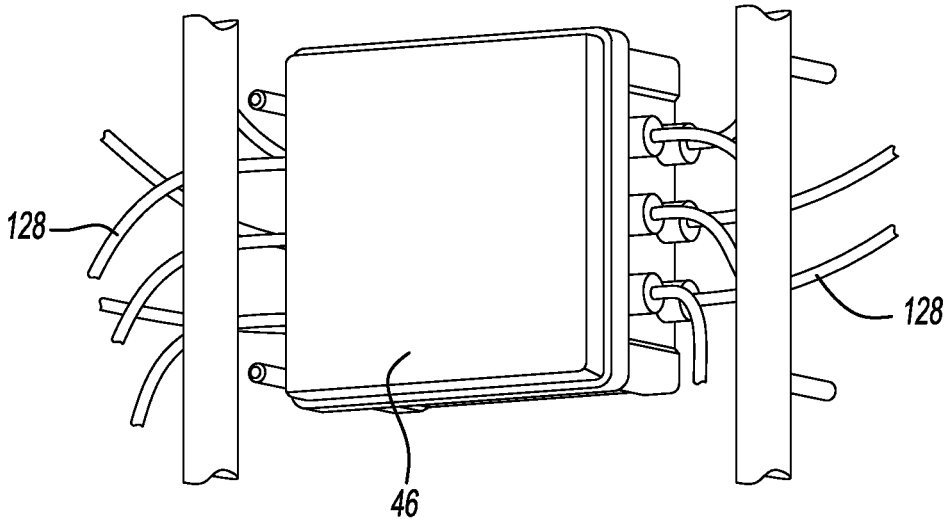
FIG. 22 illustrates an electronic valve control for an energy system.

FIG. 22 illustrates an electronic valve control 46. The electronic valve control 46 is in electronic communication with a plurality of valves via a plurality of electrical lines 128. Some of the electrical lines 128 place the control 46 in communication with the water distributor 90*c*. Some of the electrical lines 128 place the control 46 in communication with the reaction chamber 12 and catalyst source 14.

Any numerical values recited in the above application include all values from the lower value to the upper value in increments of one unit provided that there is a separation of at least 2 units between any lower value and any higher value. These are only examples of what is specifically intended and all possible combinations of numerical values between the lowest value, and the highest value enumerated are to be considered to be expressly stated in this application in a similar manner. Unless otherwise stated, all ranges include both endpoints and all numbers between the endpoints.

The terms "generally" or "substantially" to describe angular measurements may mean about +/− 10° or less, about +/− 5° or less, or even about +/− 1° or less. The terms "generally" or "substantially" to describe angular measurements may mean about +/− 0.01° or greater, about +/− 0.1° or greater, or even about +/− 0.5° or greater. The terms "generally" or "substantially" to describe linear measurements, percentages, or ratios may mean about +/− 10% or less, about +/− 5% or less, or even about +/− 1% or less. The terms "generally" or "substantially" to describe linear measurements, percentages, or ratios may mean about +/− 0.01% or greater, about +/− 0.1% or greater, or even about +/− 0.5% or greater.

The term "consisting essentially of" to describe a combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

Plural elements, ingredients, components, or steps can be provided by a single integrated element, ingredient, component, or step. Alternatively, a single integrated element, ingredient, component, or step might be divided into separate plural elements, ingredients, components, or steps. The disclosure of "a" or "one" to describe an element, ingredient, component, or step is not intended to foreclose additional elements, ingredients, components, or steps.

The invention claimed is:

1. An energy system comprising:

a) one or more catalyst sources which store one or more nanoparticles comprising at least one metal;

b) one or more water sources which store a water;

c) one or more heat sources which store a heat storage medium;

d) one or more reaction chambers into which the water, the one or more nanoparticles, and the heat storage medium are introduced, which are configured to house an exothermic reaction which takes place when the one or more nanoparticles and the water are in a presence of the heat storage medium, and in which a steam is generated from the exothermic reaction; and e) one or more turbines downstream of the one or more reaction chambers which are adapted to be driven by the steam generated within the one or more reaction chambers;

wherein the at least one metal of the one or more nanoparticles includes an aluminum; and wherein the heat storage medium includes a zeolite.

2. The energy system of claim 1, wherein the one or more nanoparticles are organic, capped nano-particles.

3. The energy system of claim 1, wherein the heat storage medium is capable of storing a heat from the exothermic reaction of the one or more nanoparticles with the water; and wherein the heat storage medium is capable of releasing the heat based upon contact with the one or more nanoparticles, the water, or both.

4. The energy system of claim 1, wherein the heat storage medium has a thermal energy density of about 100 $kWh/m^3$ to about 1,000 $kWh/m^3$.

5. The energy system of claim 1, wherein the heat storage medium is a porous solid capable of binding to the steam.

6. The energy system of claim 1, wherein the heat storage medium is a porous solid and the porous solid has a porosity of about 15% to about 90%.

7. The energy system of claim 1, wherein the one or more turbines are configured to convert the steam of the exothermic reaction to mechanical energy.

8. The energy system of claim 1, wherein the energy system is in communication with a power system configured to convert a mechanical energy to an electrical energy.

9. The energy system of claim 8, wherein the power system includes a generator; and wherein the generator is in rotational communication with the one or more turbines.

10. The energy system of claim 8, wherein the power system includes one or more fuel cells.

11. The energy system of claim 10, wherein the one or more fuel cells are in communication with the one or more turbines and are configured to receive one or more gasses captured within the one or more turbines.

12. The energy system of claim 8, wherein the power system includes one or more steam condensers; and wherein the one or more steam condensers are in fluid communication with both the one or more turbines and the one or more water sources.

13. The energy system of claim 9, wherein the generator is in electrical communication with a motor.

14. The energy system of claim 13, wherein the motor is in rotational communication with a transmission of a vehicle drivetrain.

15. A vehicle having:

a) an energy system including:

i) one or more catalyst sources which store one or more nanoparticles comprising at least one metal and the at least one metal includes an aluminum;

ii) one or more water sources which store a water;

iii) one or more heat sources which store a heat storage medium, wherein the heat storage medium includes a zeolite;

iv) one or more reaction chambers into which the water, the one or more nanoparticles, and the heat storage medium are introduced, which are configured to house an exothermic reaction which takes place when the one or more nanoparticles and the water are in a presence of the heat storage medium, and in which a steam is generated from the exothermic reaction; and v) one or more turbines downstream of the one or more reaction chambers which are adapted to be driven by the steam generated within the one or more reaction chambers;

b) a power system configured to convert a mechanical energy to an electrical energy, and which includes a generator; and c) a drivetrain in communication with the generator of the power system.

16. A method for creating energy via an energy system comprising the steps of:

a) dispensing one or more nanoparticles comprising at least one metal into one or more reaction chambers for creating an exothermic reaction with a water to generate a heat;

b) introducing a portion of the heat into a heat storage medium adapted to store thermal energy;

c) generating a steam from the combination of a presence of the heat stored within the heat storage medium, the water, and the one or more nanoparticles; and d) dispensing the steam at a pre-determined pressure to convert the steam into mechanical energy, and wherein the steam is dispensed into one or more turbines which convert the steam into the mechanical energy;

wherein the at least one metal of the one or more nanoparticles includes an aluminum; and wherein the heat storage medium includes a zeolite.

17. The vehicle of claim 15, wherein the one or more nanoparticles are organic, capped nano-particles.

18. The vehicle of claim 15, wherein the heat storage medium is capable of storing a heat from the exothermic reaction of the one or more nanoparticles with the water; and wherein the heat storage medium is capable of releasing the heat based upon contact with the one or more nanoparticles, the water, or both.

19. The vehicle of claim 15, wherein the power system includes one or more fuel cells.

20. The vehicle of claim 19, wherein the one or more fuel cells are in communication with the one or more turbines and are configured to receive one or more gasses captured within the one or more turbines.

* * * * *